US008758971B2

(12) United States Patent
Akiyama et al.

(10) Patent No.: US 8,758,971 B2
(45) **Date of Patent: *Jun. 24, 2014**

(54) IMAGE-FORMING METHOD

(75) Inventors: Kazuyoshi Akiyama, Mishima (JP); Shigenori Ueda, Toride (JP); Daisuke Tazawa, Yokohama (JP); Tomohito Ozawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 423 days.

This patent is subject to a terminal disclaimer.

(21) Appl. No.: 13/056,734

(22) PCT Filed: Dec. 16, 2009

(86) PCT No.: PCT/JP2009/071356

§ 371 (c)(1),
(2), (4) Date: Jan. 31, 2011

(87) PCT Pub. No.: WO2010/074099

PCT Pub. Date: Jul. 1, 2010

(65) Prior Publication Data

US 2011/0129776 A1 Jun. 2, 2011

(30) Foreign Application Priority Data

Dec. 26, 2008 (JP) ..... 2008-333017

(51) Int. Cl.
*G03G 21/06* (2006.01)

(52) U.S. Cl.
USPC ..... 430/125.2; 430/123.42

(58) Field of Classification Search
USPC ..... 430/125.2, 123.42
See application file for complete search history.

(56) References Cited

U.S. PATENT DOCUMENTS

| | | | |
|---|---|---|---|
| 4,569,855 | A | 2/1986 | Matsuda et al. |
| 4,683,144 | A | 7/1987 | Nishimura et al. |
| 4,683,145 | A | 7/1987 | Nishimura et al. |
| 4,683,146 | A | 7/1987 | Hirai et al. |
| 4,683,147 | A | 7/1987 | Eguchi et al. |
| 5,112,709 | A | 5/1992 | Yamazaki et al. |
| 5,392,098 | A | 2/1995 | Ehara et al. |

(Continued)

FOREIGN PATENT DOCUMENTS

| | | |
|---|---|---|
| EP | 0 898 203 A1 | 2/1999 |
| EP | 0 971 271 A1 | 1/2000 |

(Continued)

OTHER PUBLICATIONS

English language translation of JP 60-088981 (May 1985).*

(Continued)

*Primary Examiner* — Christopher Rodee
(74) *Attorney, Agent, or Firm* — Fitzpatrick, Cella, Harper & Scinto

(57) ABSTRACT

An image-forming method uses an electrophotographic photosensitive member having a surface layer formed of a hydrogenated amorphous silicon carbide in which a ratio of the number of carbon atoms to the sum of the number of silicon atoms and the number of the carbon atoms in the surface layer is 0.61 or more and 0.75 or less, and the sum of the atomic density of the silicon atoms and the atomic density of the carbon atoms in the surface layer is $6.60\times10^{22}$ atoms/cm$^3$ or more, and the peak wavelength of pre-exposure light is shorter than the peak wavelength of image exposure light.

6 Claims, 6 Drawing Sheets

(56) References Cited

U.S. PATENT DOCUMENTS

| | | | | |
|---|---|---|---|---|
| 5,455,138 | A | 10/1995 | Okamura et al. | |
| 5,480,750 | A | 1/1996 | Kawada et al. | |
| 5,582,944 | A | 12/1996 | Yamamura et al. | |
| 5,817,181 | A | 10/1998 | Okamura et al. | |
| 5,849,446 | A | 12/1998 | Hashizume et al. | |
| 5,976,745 | A | 11/1999 | Aoki et al. | |
| 6,183,930 | B1 | 2/2001 | Ueda et al. | |
| 6,233,417 | B1 | 5/2001 | Nakayama et al. | |
| 6,238,832 | B1 | 5/2001 | Hashizume et al. | |
| 6,294,299 | B2 | 9/2001 | Tsuchida et al. | |
| 6,322,943 | B1 | 11/2001 | Aoki et al. | |
| 7,157,197 | B2 | 1/2007 | Aoki et al. | |
| 7,255,969 | B2 | 8/2007 | Kojima et al. | |
| 7,498,110 | B2 | 3/2009 | Taniguchi et al. | |
| 8,323,862 | B2 * | 12/2012 | Ozawa et al. | 430/66 |
| 2001/0009747 | A1 | 7/2001 | Tsuchida et al. | |
| 2010/0021835 | A1 | 1/2010 | Akiyama et al. | |
| 2010/0021836 | A1 | 1/2010 | Ozawa et al. | |
| 2010/0021837 | A1 | 1/2010 | Ozawa et al. | |
| 2013/0114975 | A1 * | 5/2013 | Ozawa et al. | 399/159 |

FOREIGN PATENT DOCUMENTS

| | | | | | |
|---|---|---|---|---|---|
| JP | 58-080656 | A | | 5/1983 | |
| JP | 60088981 | A | * | 5/1985 | G03G 21/00 |
| JP | 62038491 | A | * | 2/1987 | G03G 21/00 |
| JP | 05-018471 | A | | 1/1993 | |
| JP | 06-102686 | A | | 4/1994 | |
| JP | 06-250425 | A | | 9/1994 | |
| JP | 07-043921 | A | | 2/1995 | |
| JP | 07-175244 | A | | 7/1995 | |
| JP | 08-022229 | A | | 1/1996 | |
| JP | 11-161120 | A | | 6/1999 | |
| JP | 2000-003055 | A | | 1/2000 | |
| JP | 3124841 | B2 | | 1/2001 | |
| JP | 2002-123020 | A | | 4/2002 | |
| JP | 2002-148907 | A | | 5/2002 | |
| JP | 2002-229303 | A | | 8/2002 | |
| JP | 2002-296987 | A | | 10/2002 | |
| JP | 2003-337437 | A | | 11/2003 | |
| JP | 2004-133397 | A | | 4/2004 | |

OTHER PUBLICATIONS

Notification of Transmittal of the International Search Report and the Written Opinion of the International Searching Authority dated Nov. 4, 2009, in related corresponding PCT International Application No. PCT/JP2009/063619.

European Search Report dated Jun. 3, 2013, in related European Patent Application No. 09834900.4.

* cited by examiner

IMAGE-FORMING METHOD

TECHNICAL FIELD

The present invention relates to an image-forming method involving the use of an electrophotographic process (hereinafter referred to also as "electrophotographic image-forming method").

BACKGROUND ART

An electrophotographic photosensitive member (hereinafter referred to also as "photosensitive member") for use in an electrophotographic image-forming method generally has a photoconductive layer (photosensitive layer) and a surface layer formed on the photoconductive layer. In addition, when the photosensitive member is requested to form images at high speeds, an amorphous silicon (hereinafter referred to also as "a-Si") and a hydrogenated amorphous silicon carbide (hereinafter referred to also as "a-SiC") are often used in the photoconductive layer and the surface layer, respectively. The surface layer formed of the a-SiC is excellent in abrasion resistance, charge-retaining performance, and light permeability.

However, when the surface layer formed of the a-SiC is used under a high-humidity environment, image deletion (which may hereinafter be referred to as "high-humidity image deletion") may occur. The high humidity image deletion refers to such an image defect that when image formation is repeatedly performed in a high-humidity environment and an image is output again after a certain time period from the completion of the repetition, characters blur or are not printed to bring about blank areas.

Moisture adsorbing to the surface of the photosensitive member is known to be one cause for the occurrence of the high humidity image deletion, so the following procedure has been conventionally adopted in order that the occurrence of the high humidity image deletion can be suppressed. The photosensitive member is heated with a photosensitive member heater at all times so that the moisture adsorbing to the surface of the photosensitive member can be reduced in amount or removed.

However, in the case where the photosensitive member heater is actuated at all times, considerable power is consumed as standby power even when an electrophotographic apparatus including the photosensitive member does not operate. As a result, an environmental load increases, and a running cost also increases.

Japanese Patent No. 3,124,841 discloses a technique involving making the atomic density of silicon atoms, carbon atoms, hydrogen atoms, or fluorine atoms in the surface layer formed of the a-SiC of a photosensitive member smaller than a predetermined value as a technique for suppressing the occurrence of the high humidity image deletion. The technique disclosed in Japanese Patent No. 3,124,841 is a technique for suppressing the occurrence of the high humidity image deletion, in which the surface layer of the photosensitive member is provided with such a coarse membrane structure that the surface of the photosensitive member is easily scraped off by a cleaning step so that a new surface adsorbing a small amount of moisture may be always formed on the surface of the photosensitive member.

However, the technique disclosed in Japanese Patent No. 3,124,841 involves the following problem. Because the surface layer of the photosensitive member is apt to be scraped off in association with its repeated use, the lifetime of the photosensitive member or of an electrophotographic apparatus including the photosensitive member is short (the durability of the photosensitive member or the apparatus is low).

In addition, a ghost is one of the problems concerning the electrophotographic image quality. The ghost is such a phenomenon that the history of an electrostatic latent image remains on a photosensitive member, so the pattern of an image previously output is output to overlap an image (toner image) transferred onto a transfer material.

A pre-exposing step of irradiating the surface of a photosensitive member with pre-exposure light to remove charge on the surface of the photosensitive member is often included in a conventional electrophotographic image-forming method after a transferring step and before a charging step with a view to suppressing the occurrence of the ghost. The peak wavelength of the pre-exposure light and the peak wavelength of image exposure light for forming an electrostatic latent image on the surface of the photosensitive member are germane to the potential characteristic of the photosensitive member and the quality of an image formed with the photosensitive member. Accordingly, the peak wavelength of the pre-exposure light and the peak wavelength of the image exposure light are properly selected in accordance with an electrophotographic image-forming method to be applied. Japanese Patent Application Laid-Open No. S58-080656 discloses, as an example of such method, an electrophotographic image-forming method in which laser light having a wavelength of 700 nm to 900 nm is used as the image exposure light and light obtained by cutting off light having a wavelength of 600 nm or more with a filter is used as the pre-exposure light so that an increase in dark current (reduction in charging performance of the photosensitive member) can be suppressed. In addition, Japanese Patent Application Laid-Open No. H08-022229 discloses an electrophotographic image-forming method in which light having a wavelength of 670 nm or more is used as the image exposure light and light having a wavelength of 620 nm or more is used as the pre-exposure light so that a state in which the depth of penetration of the pre-exposure light becomes shallow can be suppressed and the ghost can be removed.

DISCLOSURE OF THE INVENTION

Under present circumstances, an electrophotographic image-forming method is still susceptible to improvement from the viewpoints of an increase in speed at which an image is formed by the electrophotographic image-forming method, an improvement in quality of the image, consideration to an environment, and the stability of a photosensitive member upon its repeated use over a long time period.

For example, the occurrence of the high humidity image deletion is still regarded as being a trouble to be alleviated in view of a request for the improvement in quality of the image because the occurrence leads to a reduction in quality of the image. However, in the case where a photosensitive member heater is installed in an electrophotographic apparatus for suppressing the occurrence of the high humidity image deletion, considerable power as standby power is needed for continuously removing moisture from the surface of the photosensitive member of the electrophotographic apparatus even when the electrophotographic apparatus does not operate. Accordingly, the installation is not always preferable in terms of the consideration to the environment. In addition, when the technique disclosed in Japanese Patent No. 3,124,841 is employed for suppressing the occurrence of the high humidity image deletion, the surface of the photosensitive member must be scraped off at some degree of speed, so the short lifetime (low durability) of the photosensitive member or the electrophotographic apparatus is raised as a problem.

From the foregoing viewpoints, a photosensitive member having a surface layer formed of the a-SiC has been requested to have such a characteristic that high humidity image deletion hardly occurs even when no photosensitive member heater is used and the durability of the photosensitive member is not reduced (hereinafter referred to also as "high humidity image deletion resistance").

In addition, considering that the photosensitive member is repeatedly used over a long time period, the setting of the wavelength of image exposure light or pre-exposure light is still susceptible to improvement.

As described above, the surface state of an electrophotographic photosensitive member gradually changes owing to the repeated use of the photosensitive member over a long time period. In association with the change, the quantity of image exposure light or pre-exposure light which permeates the surface layer of the photosensitive member to reach the photoconductive layer of the photosensitive member also gradually changes. In such a situation, even when the image exposure light or the pre-exposure light is adjusted in consideration of the characteristics of the photosensitive member including charging performance and ghost resistance in the initial condition of the photosensitive member, the characteristics including the charging performance and the ghost resistance change owing to the repeated use of the photosensitive member over a long time period. Moreover, the influence of the pre-exposure light on the charging performance and the influence of the pre-exposure light on the ghost resistance emerge so as to be in a trade-off relationship with each other in ordinary cases, so it is difficult to continue keeping each of the charging performance and the ghost resistance in a good range over a long time period. Even the techniques disclosed in Japanese Patent Application Laid-Open No. S58-080656 and Japanese Patent Application Laid-Open No. H08-022229 described above are still insufficient to continue keeping both the charging performance and the ghost resistance in a good range over a long time period in some cases.

An object of the present invention is to provide an image-forming method (electrophotographic image-forming method) in which the above problems have been solved and high-quality images can be formed over a long time period.

The present invention relates to an image-forming method, the method including in this order:

charging the surface of an electrophotographic photosensitive member;

irradiating the charged surface of the electrophotographic photosensitive member with image exposure light to form an electrostatic latent image on the surface of the electrophotographic photosensitive member;

developing the electrostatic latent image formed on the surface of the electrophotographic photosensitive member with toner to form a toner image on the surface of the electrophotographic photosensitive member;

transferring the toner image formed on the surface of the electrophotographic photosensitive member onto a transfer material; and irradiating the surface of the electrophotographic photosensitive member with pre-exposure light to remove charge on the surface of the electrophotographic photosensitive member, wherein: the electrophotographic photosensitive member has a substrate, a photoconductive layer formed on the substrate, the photoconductive layer being formed of at least an amorphous silicon, and a surface layer formed on the photoconductive layer, the surface layer being formed of at least a hydrogenated amorphous silicon carbide;

a ratio (C/(Si+C)) of the number of carbon atoms (C) to the sum of the number of silicon atoms (Si) and the number of the carbon atoms (C) in the surface layer is 0.61 or more and 0.75 or less;

the sum of an atomic density of the silicon atoms and an atomic density of the carbon atoms in the surface layer is $6.60\times10^{22}$ atoms/cm$^3$ or more; and a peak wavelength ($\lambda_P$) of the pre-exposure light is shorter than a peak wavelength ($\lambda_I$) of the image exposure light.

The present invention can provide an image-forming method (electrophotographic image-forming method) which enables high-quality images to form over a long time period.

Further features of the present invention will become apparent from the following description of exemplary embodiments with reference to the attached drawings.

BEST MODE FOR CARRYING OUT THE INVENTION

<Electrophotographic Photosensitive Member>

Figure 1A:
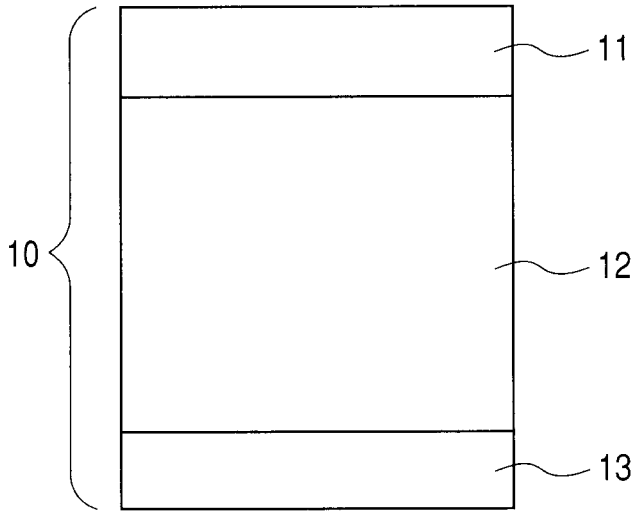
FIGS. 1A and 1B are each a view illustrating an exemplary photosensitive member for use in an image-forming method of the present invention.

An electrophotographic photosensitive member (photosensitive member) for use in an image-forming method (electrophotographic image-forming method) of the present invention includes a substrate, a photoconductive layer formed on the substrate, and a surface layer formed on the photoconductive layer.

As the substrate, preferred is a substrate which is strong enough to support the photoconductive layer and the surface layer and has conductivity. As a material for the substrate, there are exemplified metals such as aluminum, chromium, titanium, and iron, and alloys containing those metals (for example, an aluminum alloy and stainless steel). In addition, there may also be used a substrate whose surface on which the photoconductive layer is formed is subjected to conductive treatment, the substrate being formed of a synthetic resin such as polyester, polyethylene, polycarbonate, cellulose acetate, polypropylene, polyvinyl chloride, polystyrene, or polyamide, glass, ceramic, or the like.

As a form of the substrate, there are exemplified a cylindrical form and a belt form.

<Photoconductive Layer>

The photoconductive layer of the photosensitive member for use in the image-forming apparatus of the present invention is a layer formed of at least an amorphous silicon (a-Si). Further, hydrogen atoms or halogen atoms to be bonded to dangling bonds in the a-Si can be incorporated into the photoconductive layer. Those atoms are bonded to the dangling bonds of the a-Si to improve the quality of the layer, in particular, photoconductivity and charge-retaining performance. The total content of the hydrogen atoms and the halogen atoms in the photoconductive layer is preferably 10 atomic % or more, and more preferably 15 atomic % or more, with respect to the sum of silicon atoms, hydrogen atoms, and halogen atoms; in addition, the total content is preferably 30 atomic % or less, and more preferably 25 atomic % or less, with respect to the sum.

In addition, atoms for controlling conductivity may be incorporated into the photoconductive layer as required. The atoms for controlling conductivity may be incorporated into the photoconductive layer so as to be in an evenly and uniformly dispersed state, or a portion in which the atoms are incorporated in a non-uniformly dispersed state across the thickness of the layer may be present.

Examples of the atoms for controlling conductivity include the so-called impurities in the field of semiconductors. Specific examples of the atoms include: atoms belonging to the group 13 of the periodic table (hereinafter simply referred to also as "Group 13 atoms") as p-type semiconductors; and atoms belonging to the group 15 of the periodic table (hereinafter simply referred to also as "Group 15 atoms") as n-type semiconductors.

Examples of the atoms belonging to the group 13 of the periodic table include boron, aluminum, gallium, indium, and thallium, and of these, in particular, boron, aluminum, and gallium are preferable. Examples of the atoms belonging to the group 15 of the periodic table include phosphorus, arsenic, antimony, and bismuth, and of these, phosphorus and arsenic are particularly preferable.

The content of the atoms for controlling conductivity in the photoconductive layer is preferably $1\times10^{-2}$ atomic ppm or more, more preferably $5\times10^{-2}$ atomic ppm or more, and still more preferably $1\times10^{-1}$ atomic ppm or more, with respect to the silicon atoms. In addition, the content of the atoms for controlling conductivity is preferably $1\times10^{4}$ atomic ppm or less, more preferably $5\times10^{3}$ atomic ppm or less, and still more preferably $1\times10^{3}$ atomic ppm or less, with respect to the silicon atoms.

The thickness of the photoconductive layer is preferably 15 μm or more, and more preferably 20 μm or more in terms of, for example, the acquisition of a desired electrophotographic characteristic and economical efficiency; in addition, the thickness is preferably 60 μm or less, more preferably 50 μm or less, and still more preferably 40 μm or less. In the case where the thickness of the photoconductive layer is 15 μm or more, an increase in quantity of a current passing a charging member can be suppressed, so the deterioration of the photoconductive layer can be suppressed. In the case where the thickness of the photoconductive layer is 60 μm or less, when the photoconductive layer is formed as a deposit film, the abnormal growth site of the photoconductive layer can be inhibited from enlarging so as not to become 50 to 150 μm in the horizontal direction and 5 to 20 μm in the height direction. As a result, damage from a member rubbing the surface of the photosensitive member can be suppressed, so the occurrence of an image defect can be suppressed.

As described later, in the present invention, a value measured by employing spectroscopic ellipsometry was adopted as the thickness.

The photoconductive layer may be formed of a single layer, or may be formed of multiple layers in which a charge generation layer and a charge transport layer are separated from each other.

A plasma CVD method, a vacuum deposition method, a sputtering method, an ion plating method, or the like can be adopted as a method of forming the photoconductive layer. Of those methods, the plasma CVD method is preferable because, for example, a raw material can be easily supplied.

Hereinafter, a method of forming the above photoconductive layer by the plasma CVD method is described.

A raw material gas for supplying silicon atoms containing silicon atoms and a raw material gas for supplying hydrogen atoms containing hydrogen atoms are used as raw materials, and these gases are introduced into a reaction vessel in which a pressure can be reduced in a desired gas state so that glow discharge may be caused in the reaction vessel. In this case, a raw material gas for supplying halogen atoms containing halogen atoms or a raw material gas containing the above atoms for controlling conductivity can be introduced together with the above gases as required. The raw material gases are decomposed by the glow discharge, and the a-Si is deposited and caused to grow on a substrate (conductive substrate) placed in advance at a predetermined position. As a result, the photoconductive layer formed of the a-Si can be formed.

The gases of silanes such as silane ($SiH_4$) and disilane ($Si_2H_6$) can each be suitably used as the raw material gas for supplying silicon atoms. In addition, a hydrogen gas as well as the above silanes can be suitably used as the raw material gas for supplying hydrogen atoms.

<Surface Layer>

The surface layer provided on the surface of the above photosensitive member is a layer formed of at least a hydrogenated amorphous silicon carbide (a-SiC). In addition, a ratio (C/(Si+C)) of the number of carbon atoms (C) to the sum of the number of silicon atoms (Si) and the number of the carbon atoms (C) in the surface layer is 0.61 or more and 0.75 or less. In addition, the sum of the atomic density of the silicon atoms and the atomic density of the carbon atoms in the surface layer is $6.60\times10^{22}$ atoms/cm$^3$ or more.

The ratio of the number of the carbon atoms to the sum of the number of the silicon atoms and the number of the carbon atoms may hereinafter be referred to as "C/(Si+C)." In addition, the sum of the atomic density of the silicon atoms and the atomic density of the carbon atoms may hereinafter be referred to as "Si+C atomic density."

When setting the ratio between the number of the silicon atoms of which the surface layer is formed and the number of the carbon atoms of which the surface layer is formed, and the atomic densities of the atoms within the above specific ranges, the high humidity image deletion resistance of the photosensitive member can be improved while maintaining or improving the abrasion resistance of the surface layer. In addition, the alteration of the surface layer upon repetition of image formation over a long time period is suppressed, so a change in potential characteristic of the photosensitive member and changes in characteristics of an image formed with the photosensitive member are suppressed, and high-quality images in which a ghost is alleviated can be stably formed over a long time period.

The action of the surface layer is described below in more detail.

As described above, the adsorption of moisture is one cause for the high humidity image deletion, but moisture does not adsorb to the surface of the surface layer at the initial stage of using the photosensitive member in such an amount that the high humidity image deletion occurs. When the photosensitive member is used to some extent, an oxidation layer is formed on the surface of the photosensitive member mainly by a charging step owing to the influence of, for example, ozone. The oxidation layer produces polar groups on the outermost surface of the photosensitive member, so the adsorption amount of moisture may increase owing to the polar groups. When the use is further continued, the oxidation layer is continuously accumulated on the outermost surface of the photosensitive member, so the adsorption amount of moisture increases. As a result, moisture may finally adsorb to the extent that the high humidity image deletion is caused. Therefore, in order to suppress the high humidity image deletion, it is necessary to remove the oxidation layer or to suppress the formation of the oxidation layer.

In addition, once such an oxidation layer is formed, another layer different in refractive index is formed on the surface of the unaltered, normal a-SiC, so the quantity of image exposure light or pre-exposure light reaching the photoconductive layer changes owing to light interference. In addition, when image formation is repeated over a long time period, a certain toner component may adhere to the surface of the photosensitive member depending on a situation in which an electrophotographic apparatus is used. At present, what component adheres and the manner in which the component adheres have not been specifically elucidated. However, when the component is brought into a membrane shape, the membrane causes light interference as in the case of the oxidation layer, so an increase in reflectivity of the surface may occur. As a result, the quantity of the image exposure light or the pre-exposure light reaching the photoconductive layer is reduced.

The oxidation layer and the layer of the adhering substance described above are hereinafter collectively referred to also as "alteration layer". It should be noted that the term "alteration layer" is a representation used for convenience in describing an effect of the present invention, and does not always mean a physical layer state.

First, a suppressing action of the constitution of the above surface layer on the formation of the alteration layer is described. The reason why the formation of the alteration layer can be suppressed in the above surface layer is assumed to be generally as described below.

That is, the oxidation of the surface layer formed of the a-SiC is assumed to occur through the following mechanism. A substance such as ozone generated mainly by the charging step acts on the surface of the a-SiC, so a bond between a silicon atom (Si) and a carbon atom (C) is broken to liberate the C, and the C is substituted with an oxygen atom (O) instead. The oxidation involving the liberation of carbon atoms may be suppressed by increasing the atomic density of the silicon atoms and the atomic density of the carbon atoms, making an interatomic distance shorter than an ordinary one, and reducing the porosity of the surface layer. In such a surface layer, the bonding force between the atoms of which the surface layer is formed is strengthened to lead to an increase in hardness of the surface layer. Accordingly, the abrasion resistance of the surface layer may also be improved.

Since such a surface layer inhibits oxidation itself, there is no need to increase the abrasion loss of the layer for removing the oxidation layer, and the high humidity image deletion resistance of the photosensitive member can be simultaneously improved while the abrasion resistance is improved.

For the foregoing reasons, the higher the Si+C atomic density in the surface layer is, the more preferable; when setting the Si+C atomic density to $6.60\times10^{22}$ atoms/cm$^3$ or more, the humidity image deletion resistance and high abrasion resistance can be attained. In addition, when setting the Si+C atomic density in the surface layer to $6.81\times10^{22}$ atoms/cm$^3$ or more, the high humidity image deletion resistance and high abrasion resistance are additionally attained. In addition, it is considered that when the a-SiC is in an SiC crystal state, the largest Si+C atomic density can be achieved, and so, the Si+C atomic density that the surface layer can attain is theoretically $13.0\times10^{22}$ atoms/cm$^3$ or less.

Further, such a surface layer having a high Si+C atomic density is reduced in the number of dangling bonds, so its surface becomes inert. That is, the free energy of the surface is lowered, and the releasability of the surface is improved, so the adhesion of the toner component hardly occurs and the formation of the alteration layer on the surface can be suppressed.

In the present invention, a value calculated from the thickness of a surface layer determined with a spectroscopic ellipsometer (M-2000: manufactured by J.A. Woollam Co., Inc.) and the number of atoms as described later was adopted as the atomic density.

When the C/(Si+C) in the above surface layer is smaller than 0.61, the resistance of the a-SiC may be reduced. In such case, charge held on the surface of the photosensitive member is apt to drift. Although the charge drift causes a minor image defect as compared with the high humidity image deletion, in the case of an image in which isolated dots are formed with the image exposure light, dot reproducibility in an electrostatic latent image is reduced. When the dot reproducibility is reduced, the boundary between the light and dark of a dot becomes unclear, so an image defect called image blurring in which the density at the boundary is gradually lowered toward the low density side appears in an output image. The C/(Si+C) must be set to 0.61 or more in the above surface layer having a high atomic density.

In addition, particularly in the case where a surface layer formed of an a-SiC having a high atomic density is formed, when increasing the C/(Si+C), the quantity of light absorbed by the surface layer formed of the a-SiC is abruptly increased in some cases. In such a case, the quantity of image exposure light needed at the time of forming an electrostatic latent image increases, so the sensitivity of the photosensitive member is extremely reduced. Accordingly, the C/(Si+C) must be set to 0.75 or less.

As described above, it is important that the C/(Si+C) is 0.61 or more and 0.75 or less, and the Si+C atomic density is $6.60\times10^{22}$ atoms/cm$^3$ or more in the above surface layer.

In addition, a ratio (H/(Si+C+H)) of the number of hydrogen atoms (H) to the sum of the number of silicon atoms (Si), the number of carbon atoms (C), and the number of hydrogen atoms (H) in the above surface layer is preferably 0.3 or more and 0.45 or less. The ratio of the number of hydrogen atoms to the sum of the number of silicon atoms, the number of carbon atoms, and the number of hydrogen atoms is hereinafter referred to also as "H/(Si+C+H)."

When setting the H/(Si+C+H) in the surface layer to 0.30 or more, the optical band gap of the surface layer is expanded, and the photosensitivity of the photosensitive member can be improved. On the other hand, when setting the H/(Si+C+H) in the surface layer to more than 0.45, the number of terminal groups each having many hydrogen atoms such as a methyl group is apt to increase in the surface layer. When the number of terminal groups each having many hydrogen atoms such as a methyl group increases in the surface layer, a large space is formed in the structure of the a-SiC, and distortion is created in bonds between atoms present around the space, so the oxidation resistance or abrasion resistance of the surface layer tends to deteriorate.

Accordingly, the H/(Si+C+H) in the surface layer of the photosensitive member is preferably 0.30 or more and 0.45 or less, where the photosensitivity can be improved while the high humidity image deletion resistance and the abrasion resistance are maintained.

In the present invention, a value calculated from values each obtained by measuring the number of atoms of each kind in the surface layer with a back-scattering measuring apparatus (AN-2500: manufactured by Nissin High-Voltage) to which a Rutherford back-scattering method (RBS) was applied was adopted as a value for the ratio between the numbers of atoms in the surface layer.

In addition, a ratio ($I_D/I_G$) of a peak intensity $I_D$ at 1,390 $cm^{-1}$ to a peak intensity $I_G$ at 1,480 $cm^{-1}$ in the Raman spectrum of the above surface layer is preferably 0.20 or more and 0.70 or less. The ratio of the peak intensity $I_D$ at 1,390 $cm^{-1}$ to the peak intensity $I_G$ at 1,480 $cm^{-1}$ in the Raman spectrum is hereinafter referred to also as "$I_D/I_G$".

First, the Raman spectrum of the surface layer formed of the a-SiC is described while being compared with that of diamond-like carbon (hereinafter referred to also as "DLC").

The observed Raman spectrum of DLC formed from an $sp^3$ structure and an $sp^2$ structure is an asymmetric Raman spectrum having a main peak around 1,540 $cm^{-1}$ and a shoulder band around 1,390 $cm^{-1}$. In the case of the surface layer formed of the a-SiC formed by an RF-CVD method, a Raman spectrum similar to that of DLC is observed, the Raman spectrum having a main peak around 1,480 cm and a shoulder band around 1,390 $cm^{-1}$. The main peak of the surface layer formed of the a-SiC shifts to a smaller wave number as compared with that of DLC because the surface layer formed of the a-SiC contains silicon atoms. The foregoing shows that the surface layer formed of the a-SiC formed by the RF-CVD method is a material having a structure extremely close to that of DLC.

It has been generally known that the smaller the ratio of the peak intensity of a small-wave number band to the peak intensity of a large-wave number band in the Raman spectrum of DLC is, the higher the $sp^3$ characteristic of DLC tends to be. Accordingly, the smaller the ratio of the peak intensity of a small-wave number band to the peak intensity of a large-wave number band is, the higher the $sp^3$ characteristic of the surface layer tends to be because the structure of the surface layer formed of the a-SiC is extremely close to that of DLC. When the $sp^3$characteristic is increased, the number of $sp^2$ two-dimensional networks decreases, and the number of $sp^3$ three-dimensional networks increases, so the number of bonds of skeleton atoms increases, and a strong structure is formed. Accordingly, it is preferable that the smaller the ratio of the peak intensity $I_D$ at 1,390 $cm^{-1}$ to the peak intensity $I_G$ at 1,480 $cm^{-1}$ in the Raman spectrum of the surface layer is, the more preferable; when setting the ratio to 0.70 or less, the abrasion resistance of the surface layer is further improved.

In general, $sp^2$ structures cannot be completely removed from a surface layer formed of an a-SiC formed at a mass production level. Accordingly, a lower limit for the $I_D/I_G$ in the Raman spectrum of the surface layer formed of the a-SiC is preferably 0.20 at which it is confirmed that the high humidity image deletion resistance and the abrasion resistance each fall within a good range.

As described above, when setting the $I_D/I_G$ in the surface layer to 0.20 or more and 0.70 or less, the abrasion resistance can additionally be improved.

In the present invention, a value based on the Raman spectrum of a surface layer obtained with a laser Raman spectrophotometer (NRS-2000: manufactured by JASCO Corporation) was adopted as a peak intensity in the Raman spectrum.

A method of forming the above surface layer is not limited as long as a deposit film satisfying the above conditions can be formed by the method. The surface layer can be formed by any one of the known methods such as a plasma CVD method, a vacuum deposition method, a sputtering method, and an ion plating method. Of those methods, the plasma CVD method is preferable because, for example, a raw material can be easily supplied.

A method of forming the above surface layer by the plasma CVD method will be described below.

A raw material gas for supplying silicon atoms containing silicon atoms and a raw material gas for supplying carbon atoms containing carbon atoms are used as raw materials, and these gases are introduced into the reaction vessel in which a pressure can be reduced in a desired gas state so that glow discharge may be brought about in the reaction vessel. The raw material gases are decomposed by the glow discharge, and the a-SiC is deposited and grown on the photoconductive layer on the substrate (conductive substrate) placed in advance at the predetermined position. As a result, the surface layer formed of the a-SiC can be formed.

The gases of silanes such as silane ($SiH_4$) and disilane ($Si_2H_6$) can each be suitably used as the raw material gas for supplying silicon atoms. In addition, the gases of hydrocarbons such as methane ($CH_4$) and acetylene ($C_2H_2$) can each be suitably used as the raw material gas for supplying carbon atoms. In addition, a hydrogen gas ($H_2$) may be used together with the above gases mainly for adjusting the H/(Si+C+H).

Conditions under which the above surface layer is formed show such a tendency that the smaller the amount of a gas introduced into the reaction vessel (gas flow rate) is, the higher high-frequency power is, or the higher the temperature of the substrate is, the higher the Si+C atomic density is.

The photosensitive member for use in an image-forming method of the present invention may have a layer other than the above photoconductive layer and the above surface layer; for example, the photosensitive member may have a charge injection-blocking layer below or above the photoconductive layer, or may have the layers below and above the photoconductive layer. The charge injection-blocking layer is preferably formed by using as a base material a material of which the photoconductive layer is formed. In addition, a so-called changing layer in which the composition is continuously changed may be formed between these layers, as required.

Figure 1B:
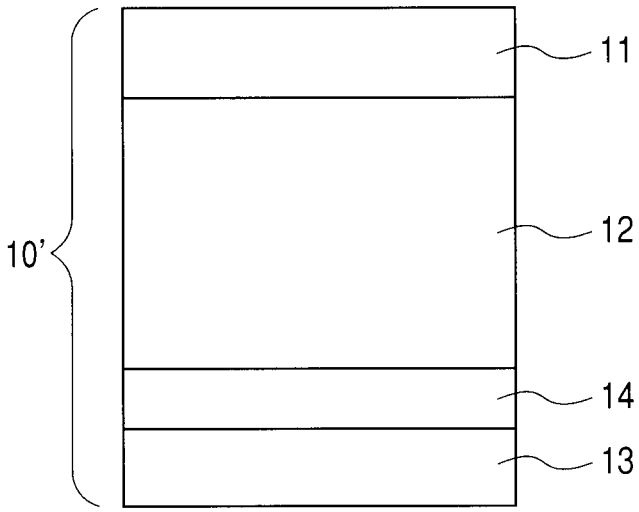

FIGS. 1A and 1B each illustrate an example of the photosensitive member for use in the image-forming method of the present invention. A photosensitive member 10 illustrated in FIG. 1A is a photosensitive member obtained by sequentially superimposing a photoconductive layer 12 and a surface layer 11 on a substrate 13. A photosensitive member 10' illustrated in FIG. 1B has a charge injection-blocking layer 14 between the substrate 13 and the photoconductive layer 12.

<Image-Forming Method>

An image-forming method of the present invention includes in this order:

a charging step of charging a surface of an electrophotographic photosensitive member;

an image exposing step of irradiating the charged surface of the electrophotographic photosensitive member with image exposure light to form an electrostatic latent image on the surface of the electrophotographic photosensitive member;

a developing step of developing the electrostatic latent image formed on the surface of the electrophotographic photosensitive member with toner to form a toner image on the surface of the electrophotographic photosensitive member;

a transferring step of transferring the toner image formed on the surface of the electrophotographic photosensitive member onto a transfer material; and a pre-exposing step of irradiating the surface of the electrophotographic photosensitive member with pre-exposure light to remove charge on the surface of the electrophotographic photosensitive member.

Figure 2:
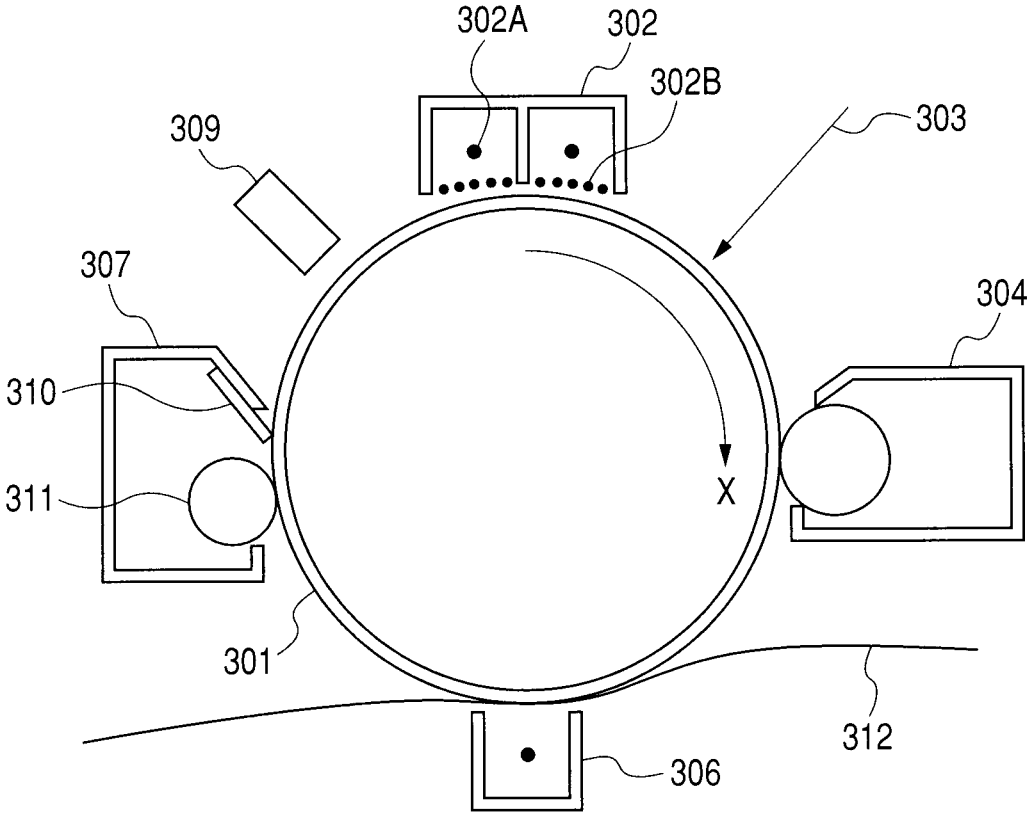
FIG. 2 is a view illustrating an example of the outline constitution of an electrophotographic apparatus for performing the image-forming method of the present invention.

FIG. 2 illustrates an example of the outline constitution of an electrophotographic apparatus for performing the image-forming method of the present invention. The electrophotographic apparatus is obtained by providing, around a photosensitive member 301, a pre-exposing unit 309 for performing the pre-exposing step, a charging unit (primary charging unit) 302 for performing the charging step, an image exposing unit (not illustrated) for performing the image exposing step by emitting image exposure light 303, a developing unit 304 for performing the developing step, and a transferring unit 306 for performing the transferring step. In addition to the foregoing, a cleaner 307, a detaching charging unit, a pre-transfer charging unit, or the like may be furnished as required.

The image-forming method of the present invention involving the use of the above electrophotographic apparatus will be described below.

The photosensitive member 301 is rotated in the direction indicated by an arrow X in FIG. 2, and the surface of the photosensitive member is charged to a predetermined potential by means of discharge generated between a charging wire 302A and a grid 302B each connected to a high-voltage power source in the charging unit 302. For example, when a light surface potential is set to 100 V, the surface of the photosensitive member is charged so that a dark surface potential is 450 V. The image exposure light 303 emitted from the image exposing unit is applied to the surface of the photosensitive member 301 so that an electrostatic latent image is formed on the surface of the photosensitive member 301. Next, the electrostatic latent image is developed with the toner of the developing unit 304 so that a toner image is formed on the surface of the photosensitive member 301. The toner image transferred onto a transfer material (such as copy paper) 312 by the transferring unit 306 is fixed on the transfer material 312 by a heat fixing unit (not illustrated). Thus, image formation is completed. The toner remaining on the surface of the photosensitive member 301 without being transferred onto the transfer material 312 is removed from the surface of the photosensitive member 301 by a cleaning blade 310 and a cleaning roller 311 in the cleaner 307. Further, pre-exposure light emitted from the pre-exposing unit 309 is applied to the surface of the photosensitive member 301 so that the potential remaining on the surface of the photosensitive member 301 may be erased.

Next, the reason why both the charging performance and ghost resistance can be retained in a good range over a long time period by the image-forming method of the present invention in which an image is formed with the photosensitive member having the above surface layer is described on the basis of the relationship between the image exposure light and the pre-exposure light.

As disclosed in Japanese Patent Application Laid-Open No. S58-080656 and Japanese Patent Application Laid-Open No. H08-022229 described above, it has been known that the charging performance or the ghost resistance changes depending on the peak wavelength ($\lambda_P$) of the pre-exposure light. Light having a higher intensity than the image exposure light is often used as the pre-exposure light in order that an excessive amount of photo carriers is generated to erase the potential remaining on the surface of the photosensitive member. In addition, the pre-exposing step is often performed at a time point much closer to the time point at which the charging step is performed by the charging unit than the image exposing step. Owing to such circumstances, when using light having a relatively longer peak wavelength ($\lambda_P$) as the pre-exposure light, the photo carriers generated in the pre-exposing step are liable to remain at the time of the charging step to some extent, so the charging performance is apt to deteriorate.

In contrast, when using light having a relatively shorter peak wavelength ($\lambda_P$) as the pre-exposure light, the photo carriers can be generated intensively in a region where the penetration depth is relatively shorter, so a probability that the photo carriers remain until the charging step can be lowered. Therefore, the use of pre-exposure light having a relatively short peak wavelength ($\lambda_P$) can efficiently erase the surface potential of the photosensitive member while suppressing the reduction of the charging performance.

The pre-exposure light generally has together the above potential-erasing effect and the effect of neutralizing photo carriers having a long lifetime generated by image exposure. From the foregoing aspect, when making the peak wavelength ($\lambda_P$) of the pre-exposure light extremely shorter than the peak wavelength ($\lambda_I$) of the image exposure light, the ghost resistance is liable to be lowered. This is probably because the pre-exposure light does not reach any photo carrier formed by the image exposure light in a region where the penetration depth in the photoconductive layer is relatively deeper. According to such an idea, the closer the peak wavelength ($\lambda_I$) of the image exposure light and the peak wavelength ($\lambda_P$) of the pre-exposure light are to each other, the more the ghost resistance can be inhibited from deteriorating.

In an actual electrophotographic image-forming method, however, when the peak wavelength ($\lambda_I$) of the image exposure light and the peak wavelength ($\lambda_P$) of the pre-exposure light are close to each other, Reduction in a ghost is not necessarily sufficient in some cases. In terms of the ghost resistance, the peak wavelength ($\lambda_P$) of the pre-exposure light is desirably made shorter to some extent as compared with the peak wavelength ($\lambda_I$) of the image exposure light. From the fact that when the process speed is increased, such a tendency becomes significant, this is inferred to relate to an increase in the probability that photo carriers generated by the image exposure light remain at the time of each of the pre-exposing step and the charging step. It is considered that complex action is caused by the difference in the penetration depth between the image exposure light and the pre-exposure light and/or the difference in the generation distribution of photo carriers between the image exposure light and the pre-exposure light caused by the difference in wavelength between the image exposure light and the pre-exposure light. The removal of the potential of an unexposed portion and the removal of photo carriers by image exposure must be performed in a balanced fashion in order that the reduction of the ghost resistance may be suppressed. As the process speed increases, the dependence of the pre-exposure light or image exposure light on the balance comes to be remarkable, so a ghost that has not been conventionally perceived is considered to manifest. As described above, the charging performance or the ghost resistance depends on the amount of photo carriers to be generated and a region where the photo carriers are generated (penetration depth of light). Accordingly, when setting the quantity of each of the image exposure light and the pre-exposure light as well as the peak wavelength ($\lambda_I$) of the image exposure light and the peak wavelength ($\lambda_P$) of the pre-exposure light can cause each of the charging performance and the ghost resistance to fall within a good range while establishing the balance between them.

However, as image formation is repeated over a long time period, the permeability of each of the image exposure light and the pre-exposure light changes owing to the alteration layer formed on the surface of the photosensitive member, so the balance between the charging performance and the ghost resistance is lost with the quantity of each of the image exposure light and the pre-exposure light which is set at the initial stage. Because a change in the quantity of light caused by the alteration layer varies depending on the wavelength of the light, the alteration layer is apt to have a larger influence on the pre-exposure light having a peak wavelength ($\lambda_P$), which is generally shorter than the peak wavelength ($\lambda_I$) of the image exposure light, rather than on the image exposure light. It has been generally difficult to keep each of the characteristics, i.e., the charging performance and the ghost resistance in a good range over a long time period because the charging performance and the ghost resistance fluctuate in directions opposite to each other with respect to the quantity of the pre-exposure light.

In contrast, the formation of the alteration layer on the outermost surface of the electrophotographic photosensitive member for use in the image-forming method of the present invention is suppressed while the abrasion loss of the above surface layer of the electrophotographic photosensitive member is kept small. Therefore, the quantity of each of the image exposure light and the pre-exposure light reaching the photoconductive layer is stably maintained. As a result, the charging performance and the ghost resistance, which are particularly apt to change, are each kept in a good range over a long time period.

A difference between the peak wavelength ($\lambda_I$) of the image exposure light and the peak wavelength ($\lambda_P$) of the pre-exposure light is preferably 15 nm or more and 60 nm or less because, as long as the difference falls within the range, the reduction of the ghost resistance can be suppressed while the charging performance is maintained. Light having a peak wavelength ($\lambda_I$) of 650 nm or more and 690 nm or less close to the peak of the optical absorption spectrum of the a-Si used in the photoconductive layer is preferably used as the image exposure light. As long as the peak wavelength falls within the above range, sufficient photoconductivity can be obtained even when its process speed is high.

When the peak wavelength ($\lambda_P$) of the pre-exposure light is 655 nm or less, the effect of suppressing the reduction of the charging performance becomes significant. When the peak wavelength is 600 nm or more, the absorption of light by the surface layer can be suppressed, so the effect of suppressing the reduction of the ghost resistance becomes significant.

The quantity of each of the image exposure light and the pre-exposure light is preferably adjusted in accordance with the peak wavelength of the light. In terms of the intensity at which the surface of the photosensitive member is irradiated with the image exposure light or the pre-exposure light (which is hereinafter referred to also as "exposure intensity"), the exposure intensity of the image exposure light is preferably 0.2 $\mu J/cm^2$ or more and 1.5 $\mu J/cm^2$ or less, and the exposure intensity of the pre-exposure light is preferably 1.5 $\mu J/cm^2$ or more and 4 $\mu J/cm^2$ or less.

A light source used for each of the image exposure light and the pre-exposure light is not particularly limited as long as the relationship between the peak wavelength ($\lambda_I$) of the image exposure light and the peak wavelength ($\lambda_P$) of the pre-exposure light is as in the above. For example, a halogen lamp or fuse lamp mounted with a band-pass filter so that its wavelength spectrum can be adjusted to a desired one, an LED array obtained by arraying LED devices on a line, or a laser device capable of scanning with the aid of a polygon mirror or the like is used. The laser device using scanning with the aid of a polygon mirror or the like is particularly suitable as the light source for the image exposure light because an image pattern can be easily formed from dots on the surface of the electrophotographic photosensitive member. In addition, the LED array is particularly suitable as the light source for the pre-exposure light because the LED array has relatively higher luminance and can easily perform uniform exposure.

The wavelength spectrum of each of the image exposure light and the pre-exposure light is preferably such that the relationship between the peak wavelength ($\lambda_I$) of the image exposure light and the peak wavelength ($\lambda_P$) of the pre-exposure light is as in the above. The wavelength spectrum is preferably steep in order that the characteristics such as the charging performance and the ghost resistance may be reproduced as designed. To be specific, the half width of the peak wavelength in the wavelength spectrum is preferably 30 nm or less. Because the LED array has a peak wavelength having a half width of 20 nm or less and the laser device has a peak wavelength having a half width of 5 nm or less, these light sources are suitably used for the pre-exposure light and the image exposure light.

<Apparatus for Producing Photosensitive Member>

Figure 3:
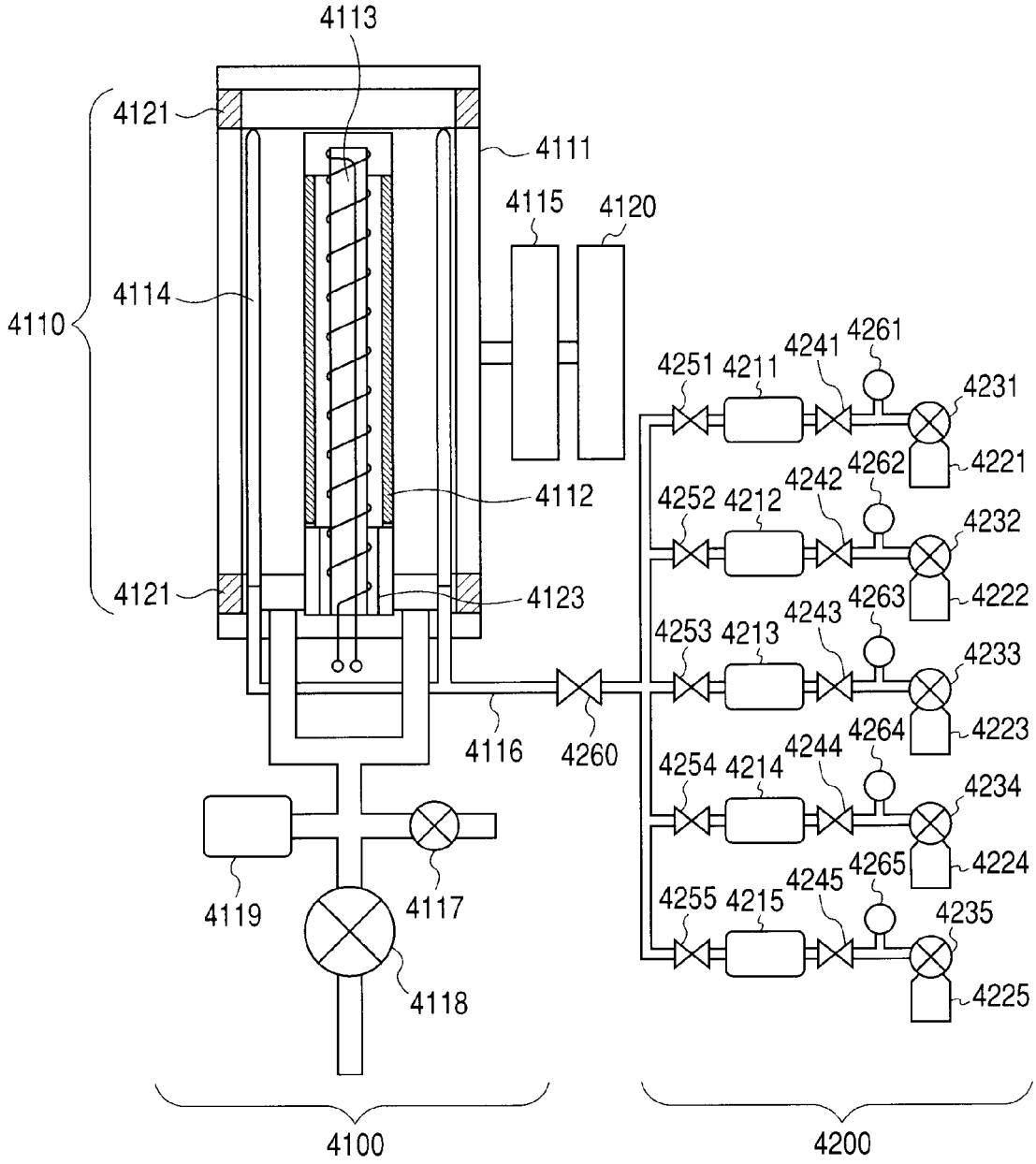
FIG. 3 is a view illustrating an example of the outline constitution of a plasma CVD apparatus applicable to the production of the photosensitive member for use in the image-forming method of the present invention.

FIG. 3 illustrates an example of the outline constitution of a plasma CVD apparatus applicable to the production of the above photosensitive member.

The plasma CVD apparatus illustrated in FIG. 3 uses a frequency in an RF band as its power supply frequency, and is composed mainly of a depositing apparatus 4100, a raw material gas-supplying apparatus 4200, and an exhaust apparatus (not illustrated) for reducing the pressure in a reaction vessel 4110 in the depositing apparatus 4100. The depositing apparatus 4100 includes an insulator 4121 and a cathode electrode 4111, and a high-frequency power supply 4120 is connected to the cathode electrode 4111 through a high-frequency matching box 4115. In addition, a mounting plate 4123 on which a cylindrical substrate 4112 is to be mounted, a heater 4113 for heating the substrate, and a raw material gas-introducing pipe 4114 are installed in the reaction vessel 4110. The reaction vessel 4110 is connected to the exhaust apparatus (not illustrated) through an exhaust valve 4118 so that the inside of the vessel can be evacuated to a vacuum. The raw material gas-supplying apparatus 4200 includes raw material gas bombs 4221 to 4225, valves 4231 to 4235, 4241 to 4245, and 4251 to 4255, and mass flow controllers 4211 to 4215. Each raw material gas bomb is connected to the gas-introducing pipe 4114 in the reaction vessel 4110 through a valve 4260.

Deposit films are formed with the plasma CVD apparatus by, for example, such procedure as described below.

First, the substrate 4112 is installed in the reaction vessel 4110, and the inside of the reaction vessel 4110 is evacuated with the exhaust apparatus (not illustrated) such as a vacuum pump. Subsequently, the temperature of the substrate 4112 is controlled to a predetermined temperature in the range of 200° C. to 350° C. with the heater 4113 for heating the substrate. Next, raw material gases for forming the deposit films are introduced into the reaction vessel 4110 with their flow rates controlled with the gas-supplying apparatus 4200. Then, the pressure of each of the gases is set to a predetermined value by manipulating the exhaust valve 4118 while watching the display of a vacuum gauge 4119.

After preparations to form the deposit films have been completed as described above, each layer (each deposit film) is formed through the following procedure.

Once the pressure becomes stable, the power of the high-frequency power supply 4120 is set to a desired value, and is supplied to the cathode electrode through the high-frequency matching box 4115 so that high-frequency glow discharge may be caused. A frequency in the RF band ranging from 1 MHz to 30 MHz can be suitably used in the discharge. Each raw material gas introduced into the reaction vessel 4110 is decomposed by energy generated by the discharge. As a result, a predetermined deposit film is formed on the substrate 4112. After a deposit film having a desired thickness has been formed, the supply of the high-frequency power is stopped, and each valve of the gas-supplying apparatus is closed so that the inflow of each raw material gas into the reaction vessel 4110 is stopped and the formation of the deposit film is finished. Such operation as described above is repeated multiple times while conditions such as the flow rate and pressure of each raw material gas, and the high-frequency power are changed. Thus, an electrophotographic photosensitive member having a desired multilayer structure is produced. In addition, it is effective in uniformizing the formation of the deposit films that the substrate 4112 is rotated at a predetermined speed with a driving apparatus (not illustrated) during the formation of the deposit films.

After all the deposit films have been formed, a leak valve 4117 is opened so that the pressure in the reaction vessel 4110 is brought into atmospheric pressure. Then, the substrate 4112 with the deposit films formed thereon (photosensitive member) is taken out.

EXAMPLES

The image-forming method of the present invention is described in more detail by way of working examples. However, the present invention is not limited to these examples.

Example 1

A photosensitive member of such a layer constitution (constitution illustrated in FIG. 1B) as to have a charge injection-blocking layer, a photoconductive layer, and a surface layer on a substrate was produced.

A cylinder obtained by subjecting the surface of an aluminum material having an outer diameter of 80 mm, a length of 358 mm, and a thickness of 3 mm to mirror finish was used as the substrate (conductive substrate), and the respective layers were formed under the conditions (film-forming conditions) shown in Table 1. In particular, with regard to the surface layer, layers having different densities were formed by changing the conditions (film-forming conditions) as shown in Table 2. It should be noted that thicknesses in Table 1 represents design values.

TABLE 1

| | Charge injection-blocking layer | Photoconductive layer | Surface layer |
|---|---|---|---|
| Species and flow rates of gases | | | |
| $SiH_4$ [mL/min (normal)] | 350 | 450 | * |
| $H_2$ [mL/min (normal)] | 750 | 2,200 | |

TABLE 1-continued

| | Charge injection-blocking layer | Photoconductive layer | Surface layer |
|---|---|---|---|
| $B_2H_6$ [ppm] (with respect to $SiH_4$) | 1,500 | 1 | |
| NO [mL/min (normal)] | 10 | | |
| $CH_4$ [mL/min (normal)] | | | * |
| Internal pressure [Pa] | 40 | 80 | * |
| High-frequency power [W] | 400 | 800 | * |
| Substrate temperature [° C.] | 260 | 260 | 290 |
| Thickness [μm] | 3 | 25 | 0.5 |

TABLE 2

| | Film-forming conditions No. | | | |
|---|---|---|---|---|
| | 1 | 2 | 3 | 4 |
| $SiH_4$ [mL/min (normal)] | 26 | 26 | 26 | 26 |
| $CH_4$ [mL/min (normal)] | 500 | 450 | 400 | 360 |
| Internal pressure [Pa] | 80 | 80 | 80 | 80 |
| High-frequency power [W] | 600 | 700 | 750 | 850 |

The characteristics of the resultant photosensitive members were measured by the following methods. Table 5 shows the results.

<C/(Si+C)>

(1) Production of Sample

A 15-mm square laminated film was cut out of the central portion in the longitudinal direction of each photosensitive member so that a sample for surface layer measurement was produced. Reference samples were similarly produced by cutting 15-mm square laminated films out of a product obtained by forming the charge injection-blocking layer on the substrate (Reference 1) and a product obtained by forming the charge injection-blocking layer and the photoconductive layer on the substrate (Reference 2).

(2) C/(Si+C)

The number of silicon atoms and number of carbon atoms of the surface layer in a measured area were measured for the sample for surface layer measurement with a back-scattering measuring apparatus (AN-2500: manufactured by Nissin High-Voltage) to which a Rutherford back-scattering method (RBS) was applied. The C/(Si+C) was calculated from the resultant numbers of atoms.

<Si+C Atomic Density>

(1) Thickness

The relationship between a wavelength and each of an amplitude ratio Ψ and a phase difference Δ of each of the sample for surface layer measurement and the reference samples was determined for each angle of incidence with a spectroscopic ellipsometer (M-2000: manufactured by J.A. Woollam Co., Inc.) under the following conditions. In this case, the optical constants of the charge injection-blocking layer and the photoconductive layer are calculated from the results measured for both References 1 and 2, and the optical constant of the surface layer is calculated from the results measured for the sample for surface layer measurement on the basis of the above optical constants.

Angle of incidence: 60°, 65°, or 70°

Measurement wavelength: 195 nm to 700 nm

Analytical software: WVASE 32

Beam diameter: 1 mm×2 mm

The relationship between a wavelength and each of the amplitude ratio Ψ and the phase difference Δ at each angle of incidence was calculated with the analytical software for a layer constitution further having a roughened surface layer having a porosity of 20 vol % on the surface layer as a calculation model. The thickness of the sample for surface layer measurement when a mean square error between the calculated value and the measured value of the sample for surface layer measurement was minimum was determined, and then the thickness of the surface layer was determined.

(2) Si+C Atomic Density

The atomic density of the silicon atoms (Si atomic density) and the atomic density of the carbon atoms (C atomic density) in the surface layer were calculated from the numbers of the silicon atoms and the carbon atoms measured with the back-scattering measuring apparatus, and the thickness of the surface layer, and then the Si+C atomic density was calculated.

<H/(Si+C+H)>

The number of hydrogen atoms of the surface layer in a measured area was measured for the sample for surface layer measurement with a back-scattering measuring apparatus (AN-2500: manufactured by Nissin High-Voltage) to which a hydrogen forward-scattering method (HFS) was applied under the following conditions. The H/(Si+C+H) was calculated from the above numbers of the silicon atoms, the carbon atoms, and the hydrogen atoms. Further, the atomic density of the hydrogen atoms (H atomic density) in the surface layer was determined from the numbers of those atoms and the thickness of the surface layer.

Incident ion: $4He^+$
Incident energy: 2.3 MeV
Angle of incidence: 75°
Sample current: 35 nA
Incident beam diameter: 1 mm
Scattering angle of the detector of the RBS: 160°
Aperture diameter of the detector of the RBS: 8 mm
Recoil angle of the detector of the HFS: 30°
Aperture diameter of the detector of the HFS: 8 mm+Slit

<$I_G/I_D$>

A 10-mm square sample for peak intensity ratio measurement cut out of the central portion in the longitudinal direction in an arbitrary circumferential direction of any one of the resultant photosensitive members was subjected to measurement with a laser Raman spectrophotometer (NRS-2000: manufactured by JASCO Corporation). The measurement was performed three times under the following measurement conditions.

Light source: $Ar^+$laser having a wavelength of 514.5 nm
Laser intensity: 20 mA
Objective lens: A magnification of 50
Center wavelength: 1,380 $cm^{-1}$
Exposure time: 30 seconds
Integration: Five times A method of analyzing the resultant Raman spectrum is described below.

Curve fitting was performed by means of Gaussian distribution with the peak wave number of a shoulder band fixed at 1,390 $cm^{-1}$ and the main peak wave number set, and not fixed, at 1,480 $cm^{-1}$. In this case, a baseline was approximated to a straight line. The $I_D/I_G$ was determined from the main peak intensity $I_G$ and the peak intensity $I_D$ of the shoulder band obtained by the curve fitting, and the average of the three measured values was adopted.

Further, each of the produced photosensitive members was installed in an electrophotographic apparatus, and an image formed by means of the apparatus was evaluated for the high humidity image deletion resistance, abrasion resistance, image blurring, charging performance, photosensitivity, oxidation resistance, toner component-adhering performance, and ghost resistance by the following methods. Table 5 shows the results.

<High Humidity Image Deletion Resistance>

The process speed of an electrophotographic apparatus (trade name: iR5065, manufactured by Canon Inc.) was set to 500 mm/sec, and the apparatus was modified so as to output an image at a resolution of 1,200 dpi. In addition, a high-voltage power source was connected from the outside to the charging unit (primary charging unit) so that the grid potential and charging current could be adjusted. With regard to an exposing system, a laser device having a peak wavelength of 670 nm and a half width of 1.5 nm was used as a light source for image exposure light, and an LED array having a peak wavelength of 630 nm and a half width of 15 nm was used as a light source for pre-exposure light. An external power supply was connected to the laser device so that the exposure value could be arbitrarily adjusted. The exposure intensity of the pre-exposure light was set to 2.4 $\mu J/cm^2$. The electrophotographic apparatus is hereinafter referred to as "modified machine A".

Any one of the photosensitive members was installed in the modified machine A, and potential conditions were set. First, the grid potential was set to 820 V, and a current to be supplied to the charging wire was adjusted in a state in which the image exposure light was turned off so that the current could be set at such a value that a dark surface potential at the position of the developing unit of the photosensitive member was 450 V. Next, the image exposure light was turned on, and its exposure value was adjusted so that a light surface potential at the position of the developing unit of the photosensitive member could be 100 V. Under the foregoing potential conditions, an A3-size, overall character chart (4 pt, print percentage of 4%) was set on an original copy plate, and an initial image was output in an environment having a temperature of 22° C. and a humidity of 50% RH. In this case, a photosensitive member heater was turned on to keep the temperature of the surface of the photosensitive member at 40° C.

After that, a continuous paper feeding test was performed. To be specific, the photosensitive member heater was turned off, and the continuous paper feeding test was performed in which an A4-size test pattern having a print percentage of 1% was printed on 25,000 sheets per day until the cumulative total number of the tested sheets came to 250,000. After the completion of the continuous paper feeding test, the modified machine was left standing in an environment having a temperature of 25° C. and a humidity of 75% RH for 15 hours. After that, the modified machine was booted while the photosensitive member heater was turned off, and an image was output with the same A3-size character chart as used in the output of the initial image.

The initial image and the image after the continuous paper feeding test were each digitized into a PDF file with a digital electrophotographic apparatus (trade name: iRC5870: manufactured by Canon Inc.) under the binary conditions of monochromatic images and 300 dpi. In the digitized image, the ratio of pixels displayed with black color in an image region corresponding to one round of the photosensitive member (251.3 mm×273 mm) (hereinafter referred to as "black ratio") was measured with an Adobe Photoshop (manufactured by Adobe). Evaluation for high humidity image deletion resistance was performed on the basis of the ratio of the black ratio of the image after the continuous paper feeding test to the black ratio of the initial image. The larger the ratio between the black ratios, the less remarkable the high humidity image deletion (i.e., the higher the high humidity image deletion resistance).

<Abrasion Resistance>

The surface layer of each photosensitive member was evaluated for its abrasion resistance on the basis of the thicknesses of the surface layer before and after image formation.

A method of measuring a thickness is as described below. Light was vertically applied to the surface of the photosensitive member with a spectrometer (manufactured by Otsuka Electronics Co., Ltd.: MCPD-2000) at a spot diameter of 2 mm, and the spectrometry of the reflected light was performed in the wavelength range of 500 nm to 750 nm. A thickness was calculated from the resultant reflection waveform by regarding the refractive index of the photoconductive layer as 3.30. A total of eighteen sites described below were subjected to the measurement, the sites being defined as nine sites in the longitudinal direction of the photosensitive member (positions at distances of 0 mm, ±50 mm, ±90 mm, ±130 mm, and ±150 mm with reference to the center) and nine sites at positions rotated by 180° with respect to the positions in the circumferential direction of the photosensitive member. The average of the values measured at the eighteen sites was defined as the thickness of the surface layer before the image formation.

The image formation was performed by continuous paper feeding in a high-humidity environment having a temperature of 25° C. and a humidity of 75% RH and under the same conditions as in the evaluation for the high humidity image deletion resistance with the photosensitive member installed in the modified machine A. After the completion of a 250,000-sheet continuous paper feeding test, the photosensitive member was taken out of the modified machine A, and the same measurement as the measurement before the image formation was performed so that the thickness of the surface layer was obtained. The difference between the thicknesses before and after the image formation was determined, and the surface layer was evaluated for its abrasion resistance. The smaller the difference between the thicknesses, the smaller the abrasion loss of the surface layer is (i.e., the higher the abrasion resistance).

<Image Blurring>

Gray level data in which an entire gray level range was uniformly distributed into seventeen stages was created with an area gray level dot screen in which dots were placed at a linear density of 170 lpi (170 lines per inch) in the 45° direction at a resolution of 1,200 dpi by using an Adobe Photoshop. In this case, a number was allocated to each gray level in accordance with the following definition, and was defined as a gray level stage: a number "16" was allocated to the darkest gray level and a number "0" was allocated to the lightest gray level.

Next, any one of the photosensitive members was installed in the modified machine A, and the same potential conditions as in the evaluation for the abrasion resistance were set, and using the gray level data, an image formed according to a text mode was output on A3-size paper. In this case, the photosensitive member heater was turned on in an environment having a temperature of 22° C. and a humidity of 50% RH to keep the temperature of the surface of the photosensitive member at 40° C. because the occurrence of the high humidity image deletion would affect an evaluation for image blurring.

The image density of the resultant image was measured for each gray level with a spectral densitometer (504, manufactured by X-Rite Inc), and the average of three measured values was used as the object of the evaluation for the image blurring.

A relative density difference when a reflection density corresponding to the gray level data which changed linearly was defined as 1.00 was determined from the reflection density of the resultant image at each gray level, and was evaluated as the image blurring. The smaller the relative density difference, the less remarkable the image blurring, i.e., the closer to a straight line the gray level representation is.

It should be noted that the peak wavelength of each of the image exposure light and the pre-exposure light was fixed in the evaluations for the high humidity image deletion resistance, the abrasion resistance, and the image blurring to standardize the conditions at the time of the image formation or for the continuous paper feeding test.

<Charging Performance and Photosensitivity>

A modified machine B was used which was obtained by modifying the modified machine A so that power to be supplied from the outside to each of the laser device used for the image exposure light and the LED array used for the pre-exposure light could be adjusted and the quantity of each of the image exposure light and the pre-exposure light could be arbitrarily adjusted. Any one of the photosensitive members was installed in the modified machine B, and a current of 1,000 μA was supplied to the charging wire in a state that the image exposure light was turned off while the grid potential was set to 820 V. In this case, the dark surface potential at the position of the developing unit of the photosensitive member was measured, and the measured value was used in an evaluation for charging performance. Next, the image exposure light was turned on, and its quantity was adjusted so that the light surface potential at the position of the developing unit of the photosensitive member was 100 V. The irradiation energy of the image exposure light in this case was used in evaluation for photosensitivity. The larger the dark surface potential, the more excellent the charging performance of the photosensitive member, and the smaller the irradiation energy, the more excellent the photoconductivity of the photosensitive member.

<Ghost Resistance>

A halftone chart obtained by printing a halftone image having a reflection density of 0.6 on the entire surface of A3-size paper was prepared. A 40-mm square paper strip on which black color having a reflection density of 1.2 had been printed was stuck to a portion at a distance of 40 mm from an end in the long side of the halftone chart and near the center of the short side of the chart. Thus, a ghost chart was prepared.

Any one of the photosensitive members was installed in the modified machine B, and the ghost chart was set on the original copy plate so that the black paper strip was at the leading end of a copy image. An image was output in an environment having a temperature of 22° C. and a humidity of 50% RH and under the condition that the photosensitive member heater was turned on to keep the temperature of the surface of the photosensitive member at 40° C. In this case, the power to be supplied to the laser device was adjusted and the quantity of the image exposure light was adjusted so that the reflection density of the halftone portion of the output image was 0.6. After a 40-mm square black portion was output at the leading end of the resultant output image, the ghost of the 40-mm square black portion might appear at a position at a distance of 251 mm in the long side direction of the image. Reflection densities were measured at five arbitrary points in the position corresponding to the ghost and at five arbitrary points around the position (position except the position of the ghost) with a reflection densitometer, and the average of the former five measured values and the average of the latter five measured values were compared. A ratio of the reflection density of the ghost to the reflection density of the periphery of the ghost was calculated from the resultant reflection densities, and was evaluated as a ghost density. Because the reflection density of the ghost becomes higher than the reflection density of the periphery, the smaller the numerical value of the ratio, the more the ghost is suppressed (i.e., the higher the ghost resistance).

<Oxidation Resistance>

Light having the same peak wavelength as that of the pre-exposure light of the modified machine B was vertically applied to the surface layer with a spectrometer (trade name: MCPD-2000, manufactured by Otsuka Electronics Co., Ltd.) at a spot diameter of 2 mm, and the intensity of reflected light was measured. The same measurement sites as those in the measurement of the abrasion resistance were subjected to the measurement, and the average of the resultant measured values was defined as an initial reflectivity. After the measurement, any one of the photosensitive members was installed in an oxidation tester (shown in FIG. 4) placed in a high-temperature, high-humidity environment having a temperature of 30° C. and a humidity of 80% RH so that the photosensitive member was placed in an oxidation state.

Figure 4:
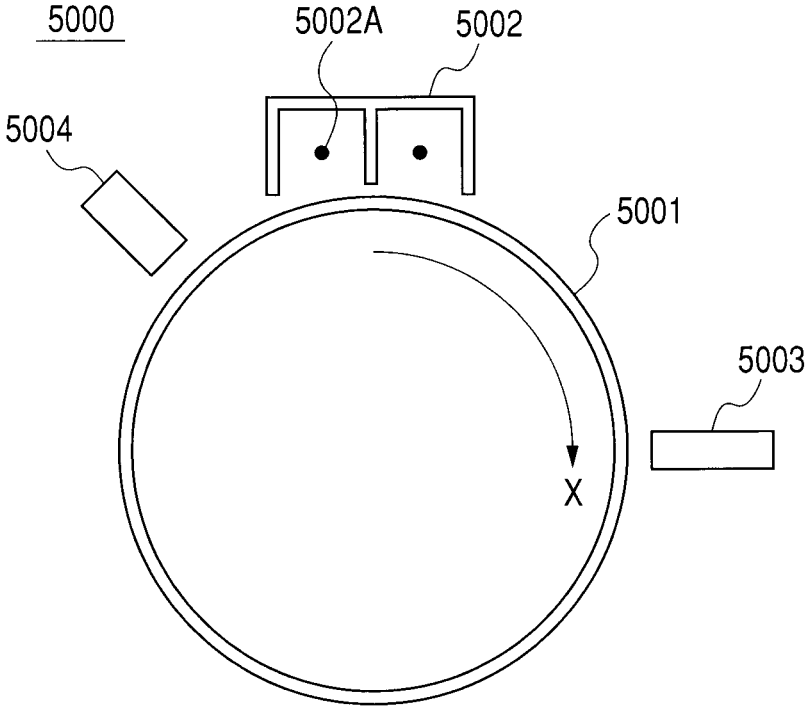
FIG. 4 is a view illustrating the outline constitution of an oxidation tester.

As illustrated in the constitution view of FIG. 4, an oxidation tester 5000 includes a charging unit 5002 for charging the surface of a photosensitive member 5001 as a test subject, a potential sensor 5003 for measuring the surface potential of the photosensitive member 5001, and a pre-exposure light source 5004. The photosensitive member 5001 is connected to a motor (not illustrated), and is set so as to rotate at the same number of revolutions as that of a digital electrophotographic apparatus (trade name: iR-5075, manufactured by Canon Inc.). The pre-exposure light source 5004 has the emission characteristics of a peak wavelength of 630 nm and a half width of 15 nm. The charging unit 5002 can provide the photosensitive member with a desired potential with the aid of a high-voltage power source (not illustrated) connected to a charging wire 5002A, and the potential is to be measured with the potential sensor 5003 in the central portion region in the axial direction of the photosensitive member. The charging unit 5002, the potential sensor 5003, and the pre-exposure light source 5004 are placed so as to have the same angles as those of the charging unit, developing unit, and pre-exposure light source of the above digital electrophotographic apparatus with respect to the central axis of the photosensitive member, respectively.

The photosensitive member was set in the oxidation tester 5000, and a black-out curtain was laid on the oxidation tester to prevent ambient light from entering the apparatus in order that potential conditions were stabilized. The pre-exposure light was turned on at an exposure value of 2.4 μJ/cm$^2$, and a value at the position of the developing unit measured with the potential sensor was adjusted to +600 V. Then, the photosensitive member was rotated for 50 consecutive hours so that the surface of the photosensitive member was charged. After that, the photosensitive member was taken out of the oxidation tester, and a reflectivity after an oxidation test was obtained in the same manner as in the initial reflectivity.

A ratio of the reflectivity after the oxidation test to the initial reflectivity was calculated from the obtained results, and evaluation was made for the oxidation resistance (reflectivity) on the basis of the reflectivity ratio. When an oxidation layer is formed on the surface of the photosensitive member, there is a strong tendency for a reflectivity to be reduced owing to light interference. Accordingly, the larger the reflectivity ratio, the more excellent in oxidation resistance the photosensitive member is.

In addition, the photosensitive member after the test was installed in the modified machine B, and was subjected to the same evaluations as those for the charging performance and the ghost resistance described above so as to be evaluated for its oxidation resistance (charging performance) and oxidation resistance (ghost). In the modified machine B, a laser device having a peak wavelength of 670 nm and a half width of 1.5 nm was used as a light source for the image exposure light and an LED array having a peak wavelength of 630 nm and a half width of 15 nm was used as a light source for the pre-exposure light, and the quantity of the pre-exposure light was set to 2.4 μJ/cm$^2$.

<Toner Component-Adhering Performance>

Figure 5:
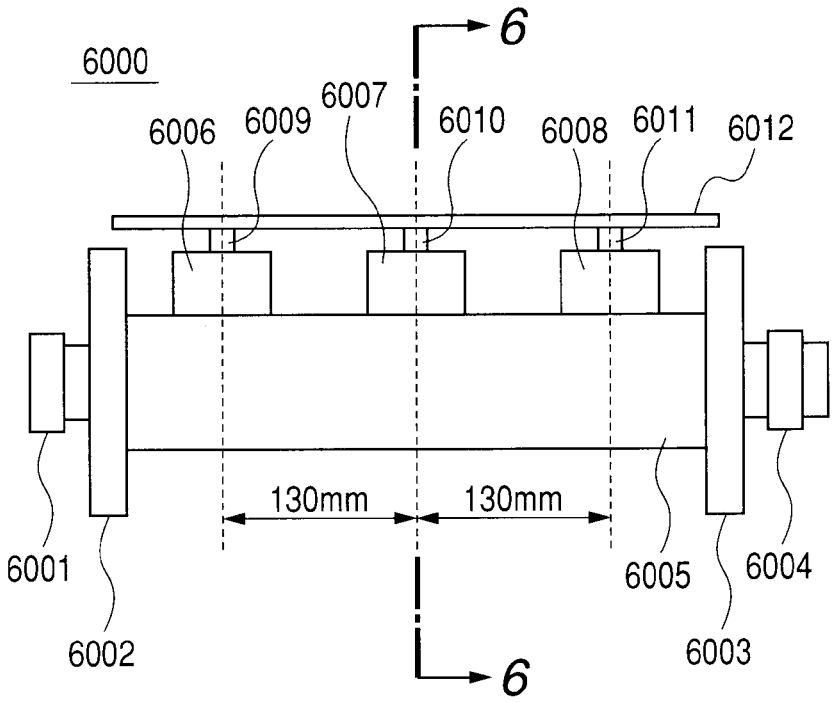
FIG. 5 is a front view illustrating part of a measuring apparatus for measuring the toner component-adhering performance of a photosensitive member.
Figure 6:
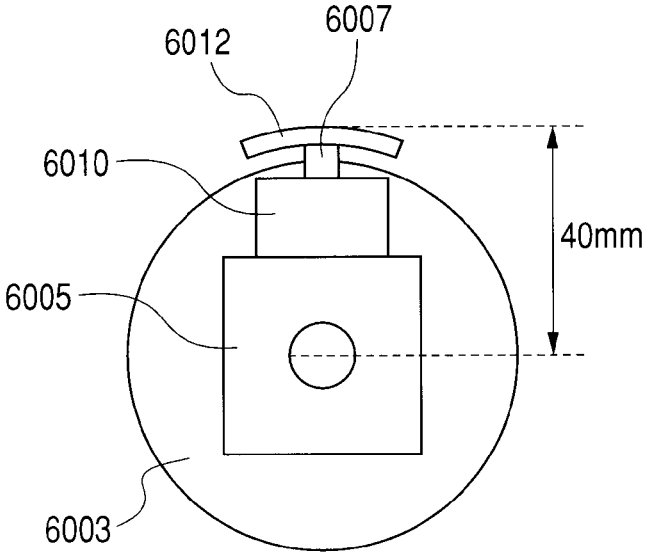
FIG. 6 is a cross-sectional view taken along the line 6-6 of FIG. 6 and viewed in the direction shown by arrows.

A continuous paper feeding test was performed with a measuring apparatus 6000 illustrated in FIG. 5 as its front view and in FIG. 6 as its side view while the contact pressure between the photosensitive members and a cleaning blade was adjusted. The measuring apparatus 6000 is such that bearings 6001 and 6004 are attached to flanges 6002 and 6003 with which a support 6005 is provided, and the apparatus is rotatively attachable to an electrophotographic apparatus as in an electrophotographic photosensitive member unit by virtue of the bearings 6001 and 6004. Load cells 6007 (trade name: TC-PAR 200N, manufactured by TEAC Corporation), 6006, and 6008 are attached to the support 6005 at a position corresponding to the center in the axial direction of the photosensitive member and positions at distances of 130 mm each in left and right directions from the position. Each load cell is connected to a display (trade name: TD-240A, manufactured by TEAC Corporation) (not illustrated) which can read out a load applied to each of load buttons 6009 to 6011 positioned at the centers of the respective load cells 6006 to 6008. A pressure-sensing plate 6012 obtained by curving an aluminum plate having a width of 30 mm, a length of 300 mm, and a thickness of 3 mm and having a mirror-finished surface in its width direction so that the plate may have a radius of 40 mm is placed at the tip of each of the load buttons 6009 to 6011. The pressure-sensing plate 6012 is mechanically connected to each load button. The center of the curvature of the pressure-sensing plate is placed so that the center coincides with the central axis of each flange and the surface of the plate is at a distance of 40 mm from the central axis of each flange.

Figure 7:
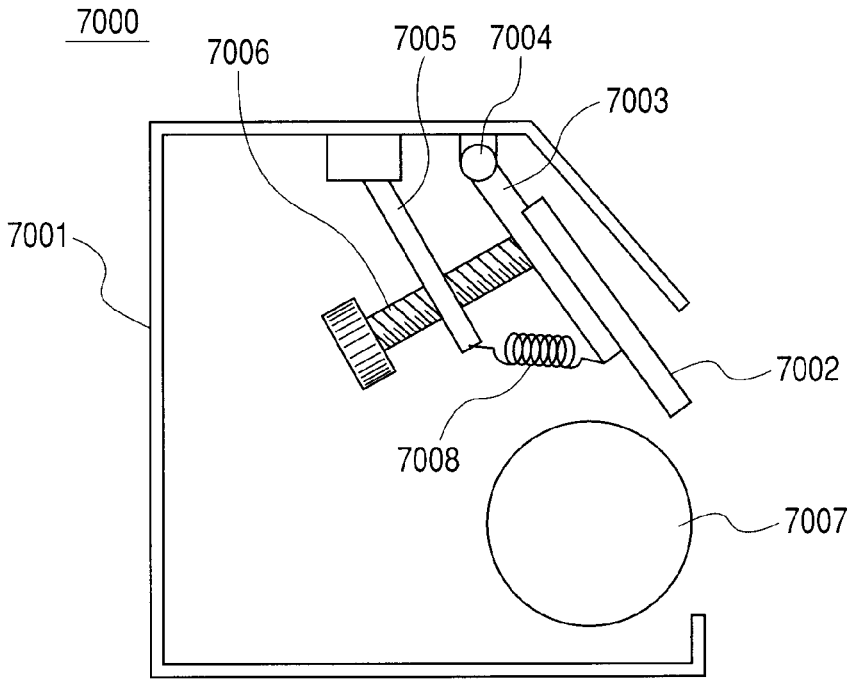
FIG. 7 is a view illustrating the outline constitution of a cleaner.

Next, a cleaner for adjusting the cleaning blade was prepared. As illustrated in the constitution view of FIG. 7, a cleaner 7000 has a body 7001, a cleaning roller 7007, and a cleaning blade 7002. The cleaning blade 7002 is supported by the body so that its angle can be changed by a supporting plate 7003 and a supporting axis 7004. The supporting plate 7003 is mechanically coupled with a plate 7005 by a spring 7008 so that its angle can be arbitrarily set by an adjusting screw 7006 while the plate is pulled toward the plate 7005. With the foregoing mechanism, the pressure at which the cleaning blade 7002 is brought into contact with the photosensitive member can be arbitrarily adjusted by the adjusting screw 7006.

The measuring apparatus 6000 and the cleaner 7000 described above were set in the modified machine A while the angle was adjusted so that the substantial center of the pressure-sensing plate 6012 was brought into contact with the tip of the cleaning blade, and the distance was adjusted so that the total of the loads applied to the three load cells came to 150 g±5 g. In this case, the contact pressure of the cleaning blade was adjusted so that the difference between the maximum and minimum of the pressures applied to the respective load cells was 10 g or less. The photosensitive member was installed in the modified machine A, and a continuous paper feeding test was performed in a high-temperature, high-humidity environment having a temperature of 30° C. and a humidity of 80% RH and under conditions identical to the potential conditions in the evaluation for the high humidity image deletion resistance. The continuous paper feeding test was performed under the condition in which the photosensitive member heater was turned on at all times during the continuous paper feeding test through the operation of the electrophotographic apparatus (modified machine A) and during stopping of the electrophotographic apparatus to keep the temperature of the surface of the photosensitive member at 40° C. The continuous paper feeding test was performed with toner produced under the under-mentioned conditions where an A4-size test pattern having a print percentage of 1% was printed on 25,000 sheets per day for four days until the number of the tested sheets came to 100,000.

After the 100,000-sheet continuous paper feeding test, the photosensitive member was taken out of the electrophotographic apparatus (modified machine A), and a reflectivity after the continuous paper feeding test was obtained in the same manner as in the evaluation for the oxidation resistance. A ratio of the reflectivity after the continuous paper feeding test to an initial reflectivity was calculated, and the photosensitive member was evaluated for its toner component-adhering performance (reflectivity) on the basis of the reflectivity ratio. When a toner component adheres to the surface of the photosensitive member, a reflectivity increases. Accordingly, the smaller the reflectivity ratio, the larger the extent to which the adhesion of the toner component is suppressed, and the photosensitive member can be said to be more excellent in toner component-adhering performance.

In addition, the photosensitive member after completion of the above continuous paper feeding test was installed in the modified machine B, and was subjected to the same evaluations as those for the charging performance and the ghost resistance described above so as to be evaluated for its toner component-adhering performance (charging performance) and toner component-adhering performance (ghost). In the modified machine B, a laser device having a peak wavelength of 670 nm and a half width of 1.5 nm was used as a light source for the image exposure light, and an LED array having a peak wavelength of 630 nm and a half width of 15 nm was used as a light source for the pre-exposure light, and the quantity of the pre-exposure light was set to 2.4 μJ/cm$^2$.

<Production Example of Toner for Evaluation of Toner Component-Adhering Performance>

Although the following toner is not necessarily used in an actual electrophotographic apparatus, the toner has been adopted because the alteration layer can be easily formed of the toner on the surface of a photosensitive member, and quantitative information about the alteration layer to be formed can be acquired.

The following materials were placed in a 5-liter autoclave provided with a reflux condenser, a moisture-separating apparatus, an $N_2$ gas-introducing pipe, a temperature gauge, and a stirring apparatus together with an esterification solvent, and were subjected to a polycondensation reaction at 230° C. while $N_2$ gas was introduced. After completion of the reaction, the reaction product was taken out of the container, and was then cooled and pulverized, thereby producing a binder resin.

| | |
|---|---|
| Propoxylated bisphenol A (2.2 mol added) | 25.0 mol % |
| Ethoxylated bisphenol A (2.2 mol added) | 25.0 mol % |
| Terephthalic acid | 37.2 mol % |
| Trimellitic anhydride | 12.8 mol % |

After the following materials were initially mixed with a Henschel mixer, the resultant was dissolved and kneaded with a biaxial kneading extruder. The resulting kneaded product was cooled and coarsely crushed with a hammer mill, and then pulverized with a turbo mill. The finely pulverized powder was classified with a multi-division classifier using a Coanda effect, and a negatively chargeable magnetic toner having a weight-average particle diameter of 5.9 μm was obtained.

| | |
|---|---|
| Binder resin | 100 parts |
| Magnetic iron oxide particles (average particle diameter 0.15 μm, Hc = 11.5 kA/m, σs = 88 Am$^2$/kg, σr = 14 Am$^2$/kg) | 70 parts |
| Fischer-Tropsch wax (melting point: 101° C.) | 4 parts |
| Charge control agent represented by the following structural formula | 2 parts |

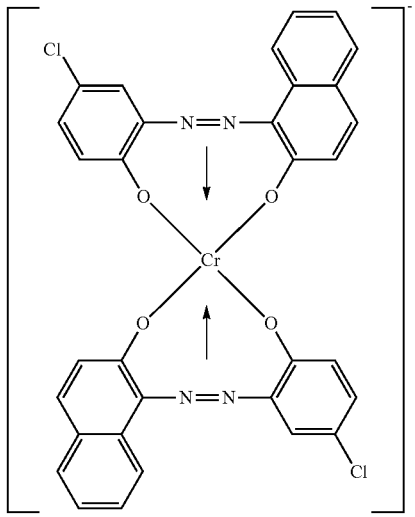

$NH_4^+$ (and $H^+$, $Na^+$, $K^+$ or mixed ions thereof

To 100 parts of the obtained magnetic toner particles, the following materials were externally added and mixed, and the resultant was passed through a sieve having a sieve opening of 150 μm, to thereby produce a toner used for evaluating toner component-adhering performance.

| | |
|---|---|
| Hydrophobic silica fine powder | 1.0 part |
| Titanium oxide fine powder as inorganic fine powder (D50: 0.3 μm) | 0.2 part |
| Strontium titanate fine powder (D50: 1.0 μm) | 3.0 parts |

The hydrophobic silica fine powder has been subjected to hydrophobic treatment with 30 parts of hexamethyldisilazane (HMDS) and 10 parts of dimethyl silicone oil with respect to 100 parts of silica fine powder with a BET specific surface area of 150 m$^2$/g.

<Measurement of Peak Wavelength and Half Width>

Figure 8:
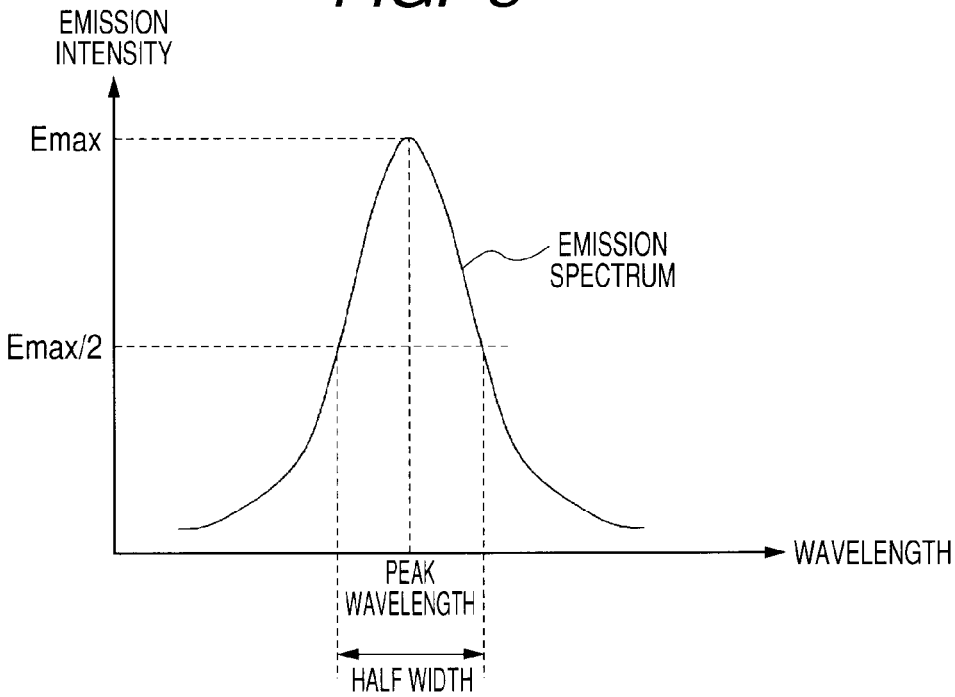
FIG. 8 is a view for explaining the half width of a peak wavelength.

A light source is placed so as to face a light-receiving portion at the fiber tip of the above spectrometer, and the distance between the light source and the light-receiving portion is arbitrarily set. Thus, an emission spectrum is obtained. When the emission spectrum is, for example, one illustrated in FIG. 8, the width between wavelengths each corresponding to an emission intensity equal to one half of the emission intensity (Emax) of an emission peak is defined as a half width (full width at half maximum).

Comparative Example 1

A photosensitive member was produced in the same manner as in Example 1 except that the surface layer was formed while the gas species, the internal pressure, and the high-frequency power were changed to the conditions (film-forming conditions) shown in Table 3. The characteristics of the resultant photosensitive member were measured, and the photosensitive member was installed in an electrophotographic apparatus. Then, an image formed with the apparatus was evaluated. Table 5 shows the results.

TABLE 3

| | Film-forming conditions No. 5 |
|---|---|
| $SiH_4$ [mL/min (normal)] | 26 |
| $CH_4$ [mL/min (normal)] | 700 |
| Internal pressure [Pa] | 80 |
| High-frequency power [W] | 450 |

Comparative Example 2

A photosensitive member was produced in the same manner as in Example 1 except that the surface layer was formed according to the conditions (film-forming conditions) shown in Table 4. The characteristics of the resultant photosensitive member were measured, and the photosensitive member was installed in an electrophotographic apparatus. Then, an image formed with the apparatus was evaluated. Table 5 shows the results.

TABLE 4

| | Charge injection-blocking layer | Photo-conductive layer | Surface layer |
|---|---|---|---|
| Species and flow rates of gases | | | |
| $SiH_4$ [mL/min (normal)] | 350 | 450 | 26 |
| $H_2$ [mL/min (normal)] | 750 | 2,200 | |
| $B_2H_6$ [ppm] (with respect to $SiH_4$) | 1,500 | 1 | |
| NO [mL/min (normal)] | 10 | | |
| $CH_4$ [mL/min (normal)] | | | 1,400 |
| Internal pressure [Pa] | 40 | 80 | 55 |
| High-frequency power [W] | 400 | 800 | 400 |
| Substrate temperature [° C.] | 260 | 260 | 260 |
| Thickness [μm] | 3 | 25 | 0.5 |

TABLE 5

| | | Comparative Example 2 | Comparative Example 1 | Example 1 | | | |
|---|---|---|---|---|---|---|---|
| | | Film-forming conditions No. | | | | | |
| | | 6 | 5 | 1 | 2 | 3 | 4 |
| Surface layer | C atomic density ($\times 10^{22}$ atoms/cm$^3$) | 1.81 | 1.61 | 1.72 | 1.81 | 1.84 | 1.94 |
| | Si atomic density ($\times 10^{22}$ atoms/cm$^3$) | 4.44 | 4.82 | 4.88 | 4.88 | 4.97 | 5.00 |
| | Si + C atomic density ($\times 10^{22}$ atoms/cm$^3$) | 6.25 | 6.42 | 6.60 | 6.69 | 6.81 | 6.94 |
| | C/(Si + C) | 0.71 | 0.75 | 0.74 | 0.73 | 0.73 | 0.72 |
| | H atomic density ($\times 10^{22}$ atoms/cm$^3$) | 4.00 | 5.25 | 4.98 | 5.26 | 4.73 | 4.82 |
| | H/(Si + C + H) | 0.39 | 0.45 | 0.43 | 0.44 | 0.41 | 0.41 |
| | $I_D/I_G$ | 0.7 | 0.69 | 0.69 | 0.67 | 0.62 | 0.61 |
| | Thickness (nm) | 498 | 491 | 495 | 496 | 499 | 489 |
| High humidity image deletion resistance | | 0.64 | 0.86 | 0.98 | 1.00 | 1.03 | 1.07 |
| Abrasion resistance | | 1.75 | 1.40 | 1.03 | 1.00 | 0.90 | 0.85 |
| Image blurring | | 1.21 | 1.40 | 0.89 | 1.00 | 1.31 | 1.25 |
| Charging performance | | 0.93 | 0.95 | 1.01 | 1.00 | 0.99 | 1.00 |
| Photosensitivity | | 0.92 | 0.96 | 1.00 | 1.00 | 1.01 | 1.02 |
| Ghost resistance | | 0.96 | 0.96 | 1.01 | 1.00 | 0.98 | 1.03 |
| Oxidation resistance (reflectivity) | | 0.88 | 0.92 | 0.98 | 1.00 | 1.01 | 1.01 |
| Oxidation resistance (charging performance) | | 0.87 | 0.92 | 0.99 | 0.98 | 1.01 | 1.03 |
| Oxidation resistance (ghost) | | 0.93 | 0.93 | 1.01 | 0.98 | 0.99 | 1.02 |
| Toner component-adhering performance (reflectivity) | | 1.18 | 1.11 | 1.03 | 1.00 | 1.01 | 1.01 |
| Toner component-adhering performance (charging performance) | | 1.15 | 1.09 | 1.03 | 0.98 | 1.00 | 1.03 |
| Toner component-adhering performance (ghost) | | 1.19 | 1.12 | 1.03 | 0.98 | 1.01 | 1.00 |

In Table 5, a value for each of the high humidity image deletion resistance, the abrasion resistance, the image blurring, the charging performance, the photosensitivity, the ghost resistance, the oxidation resistance (reflectivity), and the toner component-adhering performance (reflectivity) is a relative value with reference to the value for the corresponding item when the surface layer is formed under the film-forming conditions No. 2 of Example 1. Values for the oxidation resistance (charging performance) and the toner component-adhering performance (charging performance) are each a relative value with reference to the value for the charging performance when the surface layer is formed under the film-forming conditions No. 2 of Example 1. A value for each of the oxidation resistance (ghost) and the toner component-adhering performance (ghost) is a relative value with reference to the value for the ghost resistance when the surface layer is formed under the film-forming conditions No. 2 of Example 1. Hereinafter, unless otherwise specified, notation in any one of Tables 8 to 11, 14, and 17 is pursuant to that in Table 5.

When the value for the high humidity image deletion resistance is 0.95 or more, the photosensitive member has excellent high humidity image deletion resistance, and when the value is 1.02 or more, the photosensitive member has particularly excellent high humidity image deletion resistance.

When the value for the abrasion resistance is 1.10 or less, the photosensitive member has excellent abrasion resistance, and when the value is 0.90 or less, the photosensitive member has particularly excellent abrasion resistance.

When the value for the image blurring is 1.80 or less, such a good gray level characteristic that no tone jump is observed on an image is achieved, and when the value is 1.50 or less, particularly excellent gray level representation can be performed. No substantial difference between numerical values below 1.50 can be observed on an image, so it can be said that the values are within variations upon measurement. When the value for the charging performance is 0.93 or more, the photosensitive member has sufficient charging performance even in the case where the process speed is high.

When the value for the photosensitivity is 1.10 or less, the photosensitivity is good, and when the value is 1.05 or less, the photosensitivity is such a particularly good characteristic that the photosensitive member is applicable to a wide variety of electrophotographic image-forming methods.

When the value for the ghost resistance is 1.10 or less, the ghost resistance is such a good characteristic that a ghost is not significant on an image, and when the value is 1.06 or less, the ghost resistance is such an excellent characteristic that nearly no ghost can be observed on an image.

The oxidation resistance (reflectivity) and the toner component-adhering performance (reflectivity) are indices for quantitative comparison. Accordingly, the oxidation resistance (charging performance) and the toner component-adhering performance (charging performance) as potential characteristics have only to be evaluated on the basis of the same criteria as those for the above charging performance. In addition, the oxidation resistance (ghost) and the toner component-adhering performance (ghost) as image characteristics have only to be evaluated on the basis of the same criteria as those for the above ghost resistance.

The foregoing results show that setting the Si+C atomic density in a surface layer to $6.60\times10^{22}$ atoms/cm$^3$ or more improves the high humidity image deletion resistance and abrasion resistance of a photosensitive member including the surface layer. In addition, the results show that setting the Si+C atomic density to $6.81\times10^{22}$ atoms/cm$^3$ or more improves each of the high humidity image deletion resistance and the abrasion resistance in an additionally significant fashion. In each of Comparative Examples 1 and 2, the charging performance is somewhat low, and the ghost resistance is improved to some extent as compared with Example 1. This is probably because the absorption of each of the image exposure light and the pre-exposure light is reduced due to the characteristics of the surface layer, so the quantity of light reaching the photoconductive layer of the photosensitive member increases. With regard to the evaluation for the oxidation resistance, in each of Comparative Examples 1 and 2, the ghost resistance was improved, but the charging performance was reduced in association with a reduction in reflectivity. With regard to the evaluation for the toner component-adhering performance as well, in each of Comparative Examples 1 and 2, the charging performance was improved, but the ghost resistance was reduced in association with an increase in reflectivity. The reason for this is considered to be that a reduction in Si+C atomic density makes it easy to form the alteration layer, so the quantity of each of the image exposure light and the pre-exposure light incident on the photoconductive layer is changed.

It can be seen that, in each comparative example in which the quantity of each of the image exposure light and the pre-exposure light incident on the photoconductive layer is changed as described above, the alteration layer is easily formed, so it is difficult to suppress both the reduction of the charging performance and the reduction of the ghost resistance. It can also be seen that, on the other hand, in Example 1, the formation of the alteration layer is suppressed, so both the reduction of the charging performance and the reduction of the ghost resistance can be suppressed.

Example 2

A photosensitive member was produced in the same manner as in Example 1 except that the surface layer was formed while the gas species, the internal pressure, and the high-frequency power were changed to the conditions (film-forming conditions) shown in Table 6. The characteristics of the resultant photosensitive member were measured, and the photosensitive member was installed in an electrophotographic apparatus. Then, an image formed with the apparatus was evaluated. Table 8 shows the results.

TABLE 6

| | Film-forming conditions No. | | | | |
|---|---|---|---|---|---|
| | 7 | 8 | 9 | 10 | 11 |
| $SiH_4$ [mL/min (normal)] | 35 | 26 | 26 | 20 | 15 |
| $CH_4$ [mL/min (normal)] | 190 | 150 | 190 | 360 | 400 |
| Internal pressure [Pa] | 70 | 70 | 70 | 70 | 70 |
| High-frequency power [W] | 750 | 800 | 700 | 900 | 900 |

Comparative Example 3

A photosensitive member was produced in the same manner as in Example 1 except that the surface layer was formed while the gas species, the internal pressure, and the high-frequency power were changed to the conditions (film-forming conditions) shown in Table 7. The characteristics of the resultant photosensitive member were measured, and the photosensitive member was installed in an electrophotographic apparatus. Then, an image formed with the apparatus was evaluated. Table 8 shows the results.

TABLE 7

| | Film-forming conditions No. | |
|---|---|---|
| | 12 | 13 |
| $SiH_4$ [mL/min (normal)] | 35 | 12 |
| $CH_4$ [mL/min (normal)] | 190 | 500 |
| Internal pressure [Pa] | 70 | 70 |
| High-frequency power [W] | 700 | 900 |

TABLE 8

| | | Comparative Example 3 | Example 2 Film-forming conditions No. | | | | | Comparative Example 3 |
|---|---|---|---|---|---|---|---|---|
| | | 12 | 7 | 8 | 9 | 10 | 11 | 13 |
| Surface layer | C atomic density ($\times 10^{22}$ atoms/cm$^3$) | 3.01 | 2.89 | 2.89 | 2.58 | 1.84 | 1.76 | 1.52 |
| | Si atomic density ($\times 10^{22}$ atoms/cm$^3$) | 4.34 | 4.51 | 4.92 | 4.80 | 5.25 | 5.27 | 5.40 |
| | Si + C atomic density ($\times 10^{22}$ atoms/cm$^3$) | 7.35 | 7.4 | 7.81 | 7.38 | 7.09 | 7.02 | 6.92 |
| | C/(Si + C) | 0.59 | 0.61 | 0.63 | 0.65 | 0.74 | 0.75 | 0.78 |
| | H atomic density ($\times 10^{22}$ atoms/cm$^3$) | 3.46 | 3.32 | 3.35 | 3.32 | 4.16 | 3.95 | 4.42 |
| | H/(Si + C + H) | 0.32 | 0.31 | 0.30 | 0.31 | 0.37 | 0.36 | 0.39 |
| | $I_D/I_G$ | 0.54 | 0.52 | 0.50 | 0.58 | 0.60 | 0.63 | 0.69 |
| | Thickness (nm) | 490 | 491 | 499 | 495 | 495 | 493 | 498 |
| High humidity image deletion resistance | | 1.10 | 1.09 | 1.09 | 1.11 | 1.11 | 1.09 | 1.06 |
| Abrasion resistance | | 0.82 | 0.80 | 0.78 | 0.81 | 0.83 | 0.82 | 0.84 |
| Image blurring | | 2.13 | 1.67 | 1.52 | 1.41 | 1.23 | 1.30 | 1.09 |
| Charging performance | | 1.03 | 1.00 | 1.00 | 1.02 | 0.98 | 1.02 | 1.07 |
| Photosensitivity | | 1.00 | 1.02 | 1.01 | 1.01 | 1.03 | 1.04 | 1.14 |
| Ghost resistance | | 1.00 | 0.98 | 1.00 | 0.98 | 1.02 | 1.04 | 1.10 |
| Oxidation resistance (reflectivity) | | 1.00 | 1.01 | 1.01 | 1.00 | 0.99 | 1.02 | 1.01 |
| Oxidation resistance (charging performance) | | 1.03 | 0.97 | 1.03 | 1.05 | 0.96 | 1.00 | 1.06 |
| Oxidation resistance (ghost) | | 0.98 | 0.99 | 1.01 | 1.00 | 0.99 | 1.03 | 1.11 |
| Toner component-adhering performance (reflectivity) | | 1.00 | 0.99 | 1.01 | 1.01 | 1.01 | 1.00 | 0.99 |
| Toner component-adhering performance (charging performance) | | 1.00 | 1.03 | 0.99 | 0.99 | 1.00 | 1.03 | 1.08 |
| Toner component-adhering performance (ghost) | | 1.01 | 1.00 | 1.01 | 0.98 | 0.99 | 1.04 | 1.12 |

When the surface layer is formed under the film-forming conditions No. 13 in Comparative Example 3, the charging performance is improved to some extent, and the ghost resistance reduces to some extent in association with a reduction in photosensitivity of the photosensitive member. In addition, when the surface layer was formed under the film-forming conditions No. 12, the image blurring was observed to become worse. In Example 2, however, each of the photosensitive members provided good results in terms of the oxidation resistance and toner component-adhering performance, and showed neither a reduction in the charging performance nor a change in occurrence of a ghost after the oxidation resistance test or toner-adhering performance test.

The foregoing results show that setting the C/(Si+C) in the surface layer to 0.61 or more and 0.75 or less can inhibit the alteration of the surface of the photosensitive member, and can suppress the reduction of the charging performance and the reduction of the ghost resistance over a long time period while achieving the compatibility between the suppression of the image blurring and the photosensitivity.

Example 3

An image evaluation was performed in the same manner as in Example 1 except that photosensitive members in each of which the surface layer was formed under the film-forming conditions No. 2 in Example 1 with its thickness alone changed were used, and the laser device used for the image exposure in the modified machine B was replaced with a laser device having a peak wavelength shown in Table 9. Table 9 shows the results. It should be noted that the characteristics of the photosensitive members, which have been already shown in Table 5, are omitted.

TABLE 9

| | | Example 3 Film-forming conditions No. 2 | | | |
|---|---|---|---|---|---|
| Surface layer | Thickness (nm) | 491 | 495 | 490 | 499 |
| High humidity image deletion resistance | | 1.00 | | | |
| Abrasion resistance | | 1.01 | | | |
| Image blurring | | 0.98 | | | |

TABLE 9-continued

| | Example 3 Film-forming conditions No. 2 | | | |
|---|---|---|---|---|
| Peak wavelength of image exposure light (nm) | 635 | 650 | 658 | 670 |
| Peak wavelength of pre-exposure light (nm) | 630 | 630 | 630 | 630 |
| Wavelength difference (nm) | 5 | 20 | 28 | 40 |
| Charging performance | 0.99 | 1.01 | 1.02 | 0.98 |
| Photosensitivity | 1.09 | 1.05 | 1.04 | 0.98 |
| Ghost resistance | 1.09 | 1.03 | 0.98 | 1.00 |
| Oxidation resistance (reflectivity) | 0.98 | 1.01 | 1.00 | 1.01 |
| Oxidation resistance (charging performance) | 0.98 | 0.98 | 1.00 | 1.01 |
| Oxidation resistance (ghost) | 1.09 | 1.04 | 0.99 | 1.01 |
| Toner component-adhering performance (reflectivity) | 1.01 | 0.98 | 0.99 | 1.00 |
| Toner component-adhering performance (charging performance) | 1.00 | 0.99 | 1.00 | 1.01 |
| Toner component-adhering performance (ghost) | 1.08 | 1.03 | 0.98 | 1.01 |

In Table 9, the values for the high humidity image deletion resistance, the abrasion resistance, and the image blurring were represented by values in the case where the peak wavelength of the image exposure light was set to 635 nm. The term "wavelength difference" refers to the difference between the peak wavelength of the image exposure light and the peak wavelength of the pre-exposure light.

The foregoing results show that the photosensitivity becomes particularly good when the peak wavelength of the image exposure light is 650 nm or more. In addition, the results show that setting the peak wavelength of the image exposure light to 635 nm reduces the difference between the peak wavelength of the image exposure light and the peak wavelength of the pre-exposure light, thereby reducing the ghost resistance to some extent. A particularly good value for the ghost resistance is 1.06 or less. When the peak wavelength of the image exposure light is set to 650 nm, the ghost resistance becomes particularly good as long as the wavelength difference is about 15 nm or more.

Example 4

An image evaluation was performed in the same manner as in Example 1 except that photosensitive members in each of which the surface layer was formed under the film-forming conditions No. 2 in Example 1 with its thickness alone changed were used, and the peak wavelength of the image exposure light of the modified machine B was changed to a peak wavelength shown in Table 10.

The peak wavelength of the image exposure light was changed by using an LED array mounted with a slit having a width of 3 mm as a light source for the image exposure light, where the array was attached so as to face an image exposure position on the surface of each photosensitive member. The half width of each of the LED array fell within the range of 12 nm to 16 nm.

Since none of the LED arrays could expose an image pattern to light, a ghost chart was obtained by the procedure in which image exposure was cut off at a portion corresponding to a distance of 40 mm from the tip of A3-size paper, and the quantity of light was adjusted so that a reflection density of 0.6 was obtained in the other portions. Table 10 shows the results. It should be noted that the characteristics of the photosensitive members, which have been already shown in Table 5, are omitted.

TABLE 10

| | Example 4 Film-forming conditions No. 2 | | | |
|---|---|---|---|---|
| Surface layer Thickness (nm) | 497 | 498 | 489 | 489 |
| High humidity image deletion resistance | 0.97 | | | |
| Abrasion resistance | 1.01 | | | |
| Image blurring | 0.99 | | | |
| Peak wavelength of image exposure light (nm) | 655 | 670 | 680 | 700 |
| Peak wavelength of pre-exposure light (nm) | 630 | 630 | 630 | 630 |
| Wavelength difference (nm) | 25 | 40 | 50 | 70 |
| Charging performance | 1.00 | 1.00 | 0.98 | 1.03 |
| Photosensitivity | 1.00 | 1.00 | 1.05 | 1.09 |
| Ghost resistance | 1.02 | 1.00 | 1.00 | 1.09 |
| Oxidation resistance (reflectivity) | 0.98 | 1.00 | 1.00 | 1.00 |
| Oxidation resistance (charging performance) | 1.01 | 1.00 | 0.98 | 1.00 |
| Oxidation resistance (ghost) | 1.03 | 1.00 | 1.00 | 1.08 |
| Toner component-adhering performance (reflectivity) | 1.01 | 1.00 | 1.01 | 1.01 |
| Toner component-adhering performance (charging performance) | 1.02 | 1.00 | 0.99 | 1.03 |
| Toner component-adhering performance (ghost) | 1.01 | 1.00 | 1.01 | 1.08 |

In Table 10, the values for the high humidity image deletion resistance, the abrasion resistance, and the image blurring were represented by values in the case where the peak wavelength of the image exposure light was set to 655 nm. The term "wavelength difference" refers to the difference between the peak wavelength of the image exposure light and the peak wavelength of the pre-exposure light. A value for each of the charging performance, the photosensitivity, the ghost resistance, the oxidation resistance (reflectivity, charging performance, or ghost), and the toner component-adhering performance (reflectivity, charging performance, or ghost) is a relative value with reference to the value for the corresponding item when the peak wavelength of the image exposure light is set to 670 nm in Example 4.

When the value for the charging performance is 0.80 or more, the charging performance is good, and when the value is 0.93 or more, the photosensitive member has sufficient charging performance even in the case where its process speed is high. When the value for the photosensitivity is 1.50 or less, the photosensitivity is good, when the value is 1.10 or less, the photosensitivity is particularly good, and when the value is 1.05 or less, the photosensitivity is such an excellent characteristic that the photosensitive member is applicable to a wide variety of electrophotographic image-forming methods. When the value for the ghost resistance is 1.20 or less, the ghost resistance is such a particularly good characteristic that a ghost is not significant on an image, and when the value is 1.06 or less, the ghost resistance is such an additionally good characteristic that nearly no ghost can be observed on an image.

When the peak wavelength of the image exposure light was 680 nm or less, particularly good photosensitivity was obtained. In addition, when the wavelength difference was 70 nm, the ghost resistance was reduced to some extent. In comparison with the result in the wavelength difference of 50 nm, when the wavelength difference is 60 nm or less, a particularly good result can be obtained in the ghost resistance.

Example 4 shows that particularly good photosensitivity can be obtained when the peak wavelength of the image exposure light falls within the range of 650 nm or more to 680 nm or less and that particularly good ghost resistance can be obtained when the difference between the peak wavelength of the image exposure light and the peak wavelength of the pre-exposure light falls within the range of 15 nm or more to 60 nm or less.

Example 5

An image evaluation was performed in the same manner as in Example 1 except that photosensitive members in each of which the surface layer was formed under the film-forming conditions No. 2 in Example 1 with its thickness alone changed were used, and the laser device as a light source for the image exposure light of the modified machine B and the LED array as a light source for the pre-exposure light of the machine were replaced with those each having a peak wavelength shown in Table 11. Each laser device had a half width of 1.5 nm or less, and each LED array had a half width in the range of 12 nm to 16 nm. Table 11 shows the results. It should be noted that the characteristics of the photosensitive members, which have been already shown in Table 5, are omitted.

TABLE 11

| | | Example 5 | | | Comparative Example 4 | | |
|---|---|---|---|---|---|---|---|
| | | Film-forming conditions No. 2 | | | | | |
| Surface layer | Thickness (nm) | 491 | 493 | 499 | 490 | 499 | 489 |
| High humidity image deletion resistance | | | | 1.00 | | | |
| Abrasion resistance | | | | 0.99 | | | |
| Image blurring | | | | 1.02 | | | |
| Peak wavelength of image exposure light (nm) | | 635 | 650 | 650 | 670 | 670 | 670 |
| Peak wavelength of pre-exposure light (nm) | | 590 | 620 | 630 | 655 | 670 | 680 |
| Wavelength difference (nm) | | 45 | 30 | 20 | 15 | 0 | −10 |
| Charging performance | | 0.99 | 1.01 | 0.98 | 0.93 | 0.86 | 0.82 |
| Photosensitivity | | 1.13 | 1.08 | 1.07 | 1.00 | 1.01 | 1.02 |
| Ghost resistance | | 1.09 | 1.00 | 1.01 | 1.05 | 1.12 | 1.21 |
| Oxidation resistance (reflectivity) | | 0.98 | 0.99 | 1.01 | 0.98 | 1.00 | 0.99 |
| Oxidation resistance (charging performance) | | 1.00 | 1.00 | 0.95 | 0.91 | 0.85 | 0.83 |
| Oxidation resistance (ghost) | | 1.08 | 1.01 | 1.00 | 1.10 | 1.14 | 1.23 |
| Toner component-adhering performance (reflectivity) | | 1.01 | 1.00 | 1.02 | 1.01 | 0.98 | 0.99 |
| Toner component-adhering performance (charging performance) | | 1.01 | 0.98 | 0.95 | 0.92 | 0.86 | 0.83 |
| Toner component-adhering performance (ghost) | | 1.09 | 1.02 | 1.02 | 1.06 | 1.12 | 1.22 |

In Table 11, the values for the high humidity image deletion resistance, the abrasion resistance, and the image blurring were represented by values in the case where the peak wavelength of the image exposure light was set to 635 nm.

The results in the case where the peak wavelength of the pre-exposure light is 590 nm or 620 nm show that when setting the peak wavelength of the pre-exposure light to 600 nm or more, the value for the ghost resistance can be brought into 1.06 or less.

On the other hand, it was observed that the ghost resistance tended to be reduced to some extent as the peak wavelength of the pre-exposure light was increased to 680 nm. This is attributable to a reduction in difference in peak wavelength between the image exposure light and the pre-exposure light, and the reduction of the ghost resistance was particularly significant in the case where the difference in the peak wavelength between the image exposure light and the pre-exposure light was 0 nm and in the case of Comparative Example 4 in which the peak wavelength of the pre-exposure light was longer than that of the image exposure light. Also, it was revealed that there was such a tendency that when the difference in peak wavelength between the image exposure light and the pre-exposure light was set to 15 nm or more, the value for the ghost resistance became 1.10 or less, and when the peak wavelength of the pre-exposure light increased, the charging performance was reduced to some extent.

It was found that when the difference between the peak wavelength of the pre-exposure light and the peak wavelength of the image exposure light was kept at 15 nm or more and 60 nm or less and the peak wavelength of the pre-exposure light was set in the range of 600 nm or more to 655 nm or less, the suppression of the reduction of the charging performance and the suppression of the reduction of the ghost resistance were able to be achieved at a higher level.

Example 6

A photosensitive member was produced in the same manner as in Example 1 except that the surface layer was formed while the gas species and the high-frequency power were changed to the conditions (film-forming conditions) shown in Table 12. The characteristics of the resultant photosensitive member were measured, and the photosensitive member was installed in an electrophotographic apparatus. Then, an image formed with the apparatus was evaluated. Table 13 shows the results.

TABLE 12

| | Film-forming conditions No. | | | | |
|---|---|---|---|---|---|
| | 14 | 15 | 16 | 17 | 18 |
| $SiH_4$ [mL/min (normal)] | 26 | 26 | 26 | 26 | 26 |
| $CH_4$ [mL/min (normal)] | 200 | 350 | 400 | 450 | 600 |
| $H_2$ [mL/min (normal)] | 350 | 250 | 250 | 250 | 100 |
| High-frequency power [W] | 1,500 | 1,500 | 1,200 | 1,200 | 1,200 |

TABLE 13

| | | Example 6 | | | | |
|---|---|---|---|---|---|---|
| | | Film-forming conditions No. | | | | |
| | | 14 | 15 | 16 | 17 | 18 |
| Surface layer | C atomic density ($\times 10^{22}$ atoms/cm$^3$) | 2.60 | 2.40 | 2.29 | 2.21 | 2.12 |
| | Si atomic density ($\times 10^{22}$ atoms/cm$^3$) | 4.61 | 4.67 | 4.66 | 4.69 | 4.73 |
| | Si + C atomic density ($\times 10^{22}$ atoms/cm$^3$) | 7.21 | 7.07 | 6.95 | 6.90 | 6.85 |
| | C/(Si + C) | 0.64 | 0.66 | 0.67 | 0.68 | 0.69 |

TABLE 13-continued

| | Example 6 Film-forming conditions No. | | | | |
|---|---|---|---|---|---|
| | 14 | 15 | 16 | 17 | 18 |
| H atomic density ($\times 10^{22}$ atoms/cm$^3$) | 2.53 | 3.18 | 4.26 | 5.65 | 6.32 |
| H/(Si + C + H) | 0.26 | 0.31 | 0.38 | 0.45 | 0.48 |
| $I_D/I_G$ | 0.70 | 0.58 | 0.58 | 0.54 | 0.70 |
| Thickness (nm) | 499 | 497 | 495 | 489 | 497 |
| High humidity image deletion resistance | 1.11 | 1.09 | 1.07 | 1.07 | 1.05 |
| Abrasion resistance | 0.86 | 0.86 | 0.89 | 0.89 | 0.95 |
| Image blurring | 1.20 | 1.36 | 1.00 | 1.31 | 1.00 |
| Charging performance | 1.07 | 0.99 | 1.00 | 1.01 | 1.02 |
| Photosensitivity | 1.07 | 0.97 | 0.96 | 0.96 | 0.96 |
| Ghost resistance | 1.05 | 1.06 | 1.05 | 1.04 | 1.05 |
| Oxidation resistance (reflectivity) | 1.01 | 1.00 | 0.98 | 0.97 | 0.97 |
| Oxidation resistance (charging performance) | 1.05 | 1.02 | 0.99 | 1.00 | 0.98 |
| Oxidation resistance (ghost) | 1.05 | 0.98 | 1.00 | 0.99 | 1.01 |
| Toner component-adhering performance (reflectivity) | 1.00 | 0.99 | 1.01 | 1.01 | 0.99 |
| Toner component-adhering performance (charging performance) | 1.06 | 0.99 | 0.98 | 1.00 | 1.01 |
| Toner component-adhering performance (ghost) | 1.05 | 1.01 | 0.99 | 0.99 | 1.00 |

The fact that the H/(Si+C+H) is reduced under such film-forming conditions that the flow rate of $H_2$ is increased is probably attributable to a desorption effect exerted by a hydrogen radical.

The foregoing results show that when setting the H/(Si+C+H) in the surface layer in the range of 0.30 or more to 0.45 or less, the abrasion resistance and the photosensitivity are particularly improved. The fact that the charging performance is somewhat improved and the ghost resistance is somewhat reduced when the surface layer is formed under the film-forming conditions No. 14 is probably attributable to the absorption of the pre-exposure light by the surface layer. The formation of the alteration layer due to the oxidation resistance test or the toner component-adhering performance test was not observed to have an influence on the fact.

Example 7

Photosensitive members were each produced in the same manner as in Example 1 except that the surface layer was formed while the gas species, the internal pressure, and the high-frequency power were changed to the conditions (film-forming conditions) shown in Table 14. The characteristics of the resultant photosensitive members were measured, and the photosensitive members were each installed in an electrophotographic apparatus. Then, an image formed with the apparatus was evaluated. When forming the surface layer under the film-forming conditions No. 19, pulsed oscillation power having a frequency of 20 kHz and a duty ratio of 50% was used as the high-frequency power. Table 15 shows the results.

TABLE 14

| | Film-forming conditions No. | | | |
|---|---|---|---|---|
| | 19 | 20 | 21 | 22 |
| $SiH_4$ [mL/min (normal)] | 26 | 26 | 26 | 26 |
| $CH_4$ [mL/min (normal)] | 350 | 150 | 150 | 150 |
| $C_2H_2$ [mL/min (normal)] | 0 | 0 | 50 | 80 |

TABLE 14-continued

| | Film-forming conditions No. | | | |
|---|---|---|---|---|
| | 19 | 20 | 21 | 22 |
| Internal pressure [Pa] | 80 | 70 | 70 | 70 |
| High-frequency power [W] | 1,500 | 800 | 800 | 800 |
| High-frequency oscillation mode | Pulse 20 kHz | Continuous | Continuous | Continuous |

TABLE 15

| | | Example 7 Film-forming conditions No. | | | |
|---|---|---|---|---|---|
| | | 19 | 20 | 21 | 22 |
| Surface layer | C atomic density ($\times 10^{22}$ atoms/cm$^3$) | 2.23 | 2.89 | 2.41 | 2.31 |
| | Si atomic density ($\times 10^{22}$ atoms/cm$^3$) | 5.19 | 4.93 | 5.12 | 5.14 |
| | Si + C atomic density ($\times 10^{22}$ atoms/cm$^3$) | 7.42 | 7.82 | 7.53 | 7.45 |
| | C/(Si + C) | 0.70 | 0.63 | 0.68 | 0.69 |
| | H atomic density ($\times 10^{22}$ atoms/cm$^3$) | 3.33 | 3.35 | 3.38 | 3.51 |
| | H/(Si + C + H) | 0.31 | 0.30 | 0.31 | 0.32 |
| | $I_D/I_G$ | 0.20 | 0.52 | 0.70 | 0.79 |
| | Thickness (nm) | 489 | 491 | 490 | 496 |
| High humidity image deletion resistance | | 1.12 | 1.10 | 1.11 | 1.11 |
| Abrasion resistance | | 0.86 | 0.86 | 0.89 | 1.03 |
| Image blurring | | 1.27 | 1.00 | 1.20 | 1.39 |
| Charging performance | | 0.98 | 0.99 | 1.02 | 1.02 |
| Photosensitivity | | 0.98 | 0.98 | 0.99 | 0.98 |
| Ghost resistance | | 1.10 | 1.07 | 1.03 | 1.03 |
| Oxidation resistance (reflectivity) | | 1.01 | 0.98 | 1.00 | 0.99 |
| Oxidation resistance (charging performance) | | 1.00 | 0.98 | 1.02 | 1.02 |
| Oxidation resistance (ghost) | | 1.02 | 0.98 | 0.99 | 1.00 |
| Toner component-adhering performance (reflectivity) | | 1.00 | 1.02 | 1.02 | 1.01 |

TABLE 15-continued

| | Example 7 Film-forming conditions No. | | | |
|---|---|---|---|---|
| | 19 | 20 | 21 | 22 |
| Toner component-adhering performance (charging performance) | 1.00 | 1.02 | 0.98 | 1.00 |
| Toner component-adhering performance (ghost) | 1.02 | 1.00 | 0.99 | 0.98 |

The foregoing results show that when setting the $I_D/I_G$ to 0.20 or more and 0.70 or less, the abrasion resistance is particularly improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-333017, filed on Dec. 26, 2008 which is hereby incorporated by reference herein in its entirety.

The invention claimed is:

1. An image-forming method comprising the steps of, in this order:

charging a surface of an electrophotographic photosensitive member;

irradiating the charged surface of the electrophotographic photosensitive member with image exposure light to form an electrostatic latent image on the surface of the electrophotographic photosensitive member;

developing the electrostatic latent image formed on the surface of the electrophotographic photosensitive member with toner to form a toner image on the surface of the electrophotographic photosensitive member;

transferring the toner image formed on the surface of the electrophotographic photosensitive member onto a transfer material; and irradiating the surface of the electrophotographic photosensitive member with pre-exposure light to remove the charge on the surface of the electrophotographic photosensitive member in the stated order, wherein:

the electrophotographic photosensitive member has a substrate, a photoconductive layer formed on the substrate, the photoconductive layer being formed of at least an amorphous silicon, and a surface layer formed on the photoconductive layer, the surface layer being formed of at least a hydrogenated amorphous silicon carbide;

a ratio (C/(Si+C)) of the number of carbon atoms (C) to the sum of the number of silicon atoms (Si) and the number of the carbon atoms (C) in the surface layer is 0.61 or more and 0.75 or less;

the sum of an atomic density of the silicon atoms and an atomic density of the carbon atoms in the surface layer is $6.60\times10^{22}$ atoms/cm$^3$ or more; and a peak wavelength ($\lambda_P$) of the pre-exposure light is shorter than a peak wavelength ($\lambda_I$)of the image exposure light.

2. An image-forming method according to claim 1, wherein a difference ($\lambda_I$-$\lambda_P$) between the peak wavelength ($\lambda_I$) of the image exposure light and the peak wavelength ($\lambda_P$) of the pre-exposure light is 15 nm or more and 60 nm or less.

3. An image-forming method according to claim 1, wherein the peak wavelength ($\lambda_P$) of the pre-exposure light falls within a range of 600 nm or more to 655 nm or less, and the peak wavelength ($\lambda_I$) of the image exposure light falls within a range of 650 nm or more to 690 nm or less.

4. An image-forming method according to claim 1, wherein a ratio (H/(Si+C+H)) of the number of hydrogen atoms (H) to the sum of the number of the silicon atoms (Si), the number of the carbon atoms (C), and the number of the hydrogen atoms (H) in the surface layer is 0.30 or more and 0.45 or less.

5. An image-forming method according to claim 1, wherein the sum of the atomic density of the silicon atoms and the atomic density of the carbon atoms in the surface layer is $6.81\times10^{22}$ atoms/cm$^3$ or more.

6. An image-forming method according to claim 1, wherein a ratio ($I_D/I_G$) of a peak intensity ($I_D$) at 1,390 cm$^{-1}$ to a peak intensity ($I_G$) at 1,480 cm$^{-1}$ in a Raman spectrum of the surface layer is 0.20 or more and 0.70 or less.

* * * * *